US007121321B2

(12) United States Patent
Thibault et al.

(10) Patent No.: US 7,121,321 B2
(45) Date of Patent: Oct. 17, 2006

(54) DIE-CASTING MACHINE

(75) Inventors: Carl Thibault, Varennes (CA); Jean-Pierre Ouellet, Ste-Julie (CA); Irina Oluhova, Montréal (CA); Cyril Trincat, Montréal (CA)

(73) Assignee: Techmire Ltd., Ville d'Anjou (CA)

( * ) Notice: Subject to any disclaimer, the term of this patent is extended or adjusted under 35 U.S.C. 154(b) by 0 days.

(21) Appl. No.: 10/819,224

(22) Filed: Apr. 7, 2004

(65) Prior Publication Data

US 2004/0188054 A1 Sep. 30, 2004

Related U.S. Application Data

(62) Division of application No. 10/368,626, filed on Feb. 20, 2003, now Pat. No. 6,978,823.

(30) Foreign Application Priority Data

Feb. 13, 2003 (WO) ..... PCT/CA03/00213

(51) Int. Cl.
*B22D 17/02* (2006.01)

(52) U.S. Cl. ..... 164/312; 164/316

(58) Field of Classification Search ..... 164/113, 164/312, 316

See application file for complete search history.

(56) References Cited

U.S. PATENT DOCUMENTS 2,004,959 A * 6/1935 Morin et al. ..... 29/527.6
3,548,922 A 12/1970 Carlsen
3,646,990 A 3/1972 Cross
4,059,143 A 11/1977 Morita et al.
4,219,068 A 8/1980 Greenwood
4,231,416 A 11/1980 Nikolov et al.
4,261,414 A 4/1981 Frenette et al.
4,439,915 A * 4/1984 Gellert ..... 29/611
4,482,001 A 11/1984 Smedley et al.
4,505,317 A 3/1985 Prince
4,591,476 A 5/1986 Greenwood et al.
4,593,741 A * 6/1986 Caugherty ..... 164/337
4,595,044 A 6/1986 Caugherty et al.
4,638,849 A * 1/1987 Whitehorn ..... 164/311
5,191,929 A 3/1993 Kubota et al.
5,203,397 A * 4/1993 Bandyopadhyay ..... 164/309
5,299,623 A 4/1994 Yaffe et al.
5,566,742 A 10/1996 Nemoto
5,605,187 A 2/1997 Perrella et al.
5,628,358 A 5/1997 Perrella et al.

(Continued)

FOREIGN PATENT DOCUMENTS

GB 1 602 579 11/1981

(Continued)

*Primary Examiner*—Kevin P. Kerns
(74) *Attorney, Agent, or Firm*—Ogilvy Renault LLP

(57) ABSTRACT

An injection unit for a hot-chamber die-casting machine has an injection portion with a gooseneck and a nozzle adaptor. The injector portion has a base portion at an end of the gooseneck adapted to receive a molten medium supply. A nozzle at an end of the nozzle adaptor is adapted to inject the molten medium supply in a die cavity. A channel between the base portion and nozzle is adapted to convey the molten medium supply therethrough. A piston chamber in the base portion is actuatable to draw the molten medium supply therein and to direct the molten medium supply in the channel for injection into the die cavity. An actuation portion is connected to the gooseneck to actuate the piston chamber. Heating cartridges are received in the injection portion adjacent to the channel to control temperature of the molten medium supply in the channel.

14 Claims, 19 Drawing Sheets

U.S. PATENT DOCUMENTS

| | | | | |
|---|---|---|---|---|
| 5,638,888 | A | 6/1997 | Perrella et al. | |
| 5,701,944 | A | 12/1997 | Young | |
| 5,787,962 | A | 8/1998 | Perrella et al. | |
| 5,960,854 | A * | 10/1999 | Fink et al. | 164/316 |
| 6,169,272 | B1 * | 1/2001 | Racine et al. | 219/424 |
| 6,237,672 | B1 | 5/2001 | Perrella et al. | |
| 6,334,479 | B1 | 1/2002 | Pollak et al. | |
| 6,354,359 | B1 | 3/2003 | Perrella et al. | |
| 6,648,057 | B1 * | 11/2003 | Dworog et al. | 164/312 |
| 6,742,570 | B1 * | 6/2004 | Kono | 164/312 |
| 6,745,821 | B1 * | 6/2004 | Wilson | 164/342 |
| 6,793,002 | B1 * | 9/2004 | Pollak et al. | 164/312 |
| 6,830,094 | B1 * | 12/2004 | Fink | 164/113 |
| 6,978,823 | B1 * | 12/2005 | Thibault et al. | 164/316 |
| 2001/0009186 | A1 | 7/2001 | Perrella et al. | |
| 2002/0056537 | A1 * | 5/2002 | Fink | 164/113 |

FOREIGN PATENT DOCUMENTS

| | | |
|---|---|---|
| JP | 55-136554 | * 10/1980 |
| WO | WO 01/87519 | 11/2001 |

* cited by examiner

DIE-CASTING MACHINE

CROSS-REFERENCE TO RELATED APPLICATIONS

This application is a divisional of U.S. patent application Ser. No. 10/368,626, filed on Feb. 20, 2003, now U.S. Pat. No. 6,978,823 and claims priority on International Patent Application No. PCT/CA03/00213, filed on Feb. 13, 2003.

FIELD OF THE INVENTION

The present invention generally relates to die casting and, more particularly, to a parting-line injection, multiple-slide die-casting machine that can be used with various casting media, e.g., magnesium, zinc, aluminum.

BACKGROUND OF THE INVENTION

Magnesium alloys have become increasingly popular for their distinct characteristics. Magnesium is the lightest of all structural materials, and has excellent strength-to-weight ratio and stiffness. Also, magnesium has EMI shielding properties, and is thus widely used in electronic devices. For example, magnesium is now used in cellular phones, cameras, CD players and other handheld devices. Accordingly, die-casting machines have been adapted over the years to produce components in magnesium.

In the die-casting industry, there are generally two types of casting machines. The conventional die-casting machine has a moving platen and a fixed platen, the platens having complementary die portions. The moving portion is displaceable so as to form a cavity with its die portion and the die portion of the fixed platen. An injection unit is positioned in the fixed part and is supplied with molten medium from an injector unit so as to fill the cavity with the molten medium. The molten medium solidifies in the cavity in the shape thereof. The cast piece is then ejected from the cavity by the separation of the moving part from the fixed part. The injection unit is either directly positioned in a molten metal bath, in the case of a hot chamber die casting machine, or receives a molten metal supply from a surrounding furnace, in the case of a cold chamber die-casting machine.

In parting-line casting, a multiple-slide die-casting machine is used, and has two or more moving slides each having a die portion. The slides meet to form a die cavity from all of the die portions. The injection unit is generally positioned on the parting line between a pair of slides, hence giving it the name "parting-line injection/casting." More complex parts can be cast in parting-line casting than in conventional casting. However, more complex motions are also involved. Typically, the slides are each displaceable. The die, resulting from the cooperation of the slides, and the injection unit must meet for the injection. Therefore, there must be some relative displacement between the injection unit and the slides.

One of the ways to perform the cooperation between the slides and the injection unit is to provide mobility to the injection unit. The injection unit has a portion thereof in a bath of molten casting medium from which it supplies the die. In the case of conventional magnesium die-casting, the bath of molten magnesium has a film of shielding fluid on a top surface thereof to reduce oxidation between the molten magnesium and the ambient oxygen. Displacements of the injection unit in the bath create an exposure of the molten medium, but the shielding film on the surface of the bath ensures that the molten magnesium is not overexposed to oxygen, or to air moisture. However, in previous attempts to cast pieces in magnesium in parting-line casting, because of the reactive nature of molten magnesium due to its relatively high melting point, the displacement of the injection unit in the molten bath of magnesium causes waves in the liquid metal. The waves disturb the shielding gas, and this results in oxidation, thereby necessitating frequent cleaning to remove the oxide build-ups.

Magnesium has a relatively high melting point, but a relatively low specific heat. There is a risk of solidification of the magnesium prior to the molten magnesium reaching the die. Therefore, temperature control is an important aspect of magnesium die-casting.

Also, molten magnesium is highly reactive and safety measures must be taken when magnesium is cast. For instance, extensive use of hydraulic fluid should be limited. It is desirable to adapt parting-line die-casting technology to magnesium, to enable the casting of more complex cast products.

SUMMARY OF THE INVENTION

It is a feature of the present invention to provide a novel parting-line multiple-slide die-casting machine to be used, although not exclusively, with magnesium.

It is a further feature of the present invention to provide a die-casting machine in which oxidation of casting medium is reduced.

It is a still further feature of the present invention to provide a die-casting machine incorporating the above two features of the present invention.

It is a still further feature of the present invention to provide a novel injection unit for hot chamber die casting.

It is a still further feature of the present invention to adapt the injection unit to the magnesium die-casting machine of the present invention.

According to the above features of the present invention, from a broad aspect, there is provided a multiple-slide die-casting machine for casting of magnesium pieces, comprising: a frame; a table operatively mounted to the frame; a slide guiding mechanism secured to the table and having at least two slides, each said slide having a die section at an operating end thereof, the at least two slides being actuatable in a close/open action such that the die sections mate at a parting line therebetween to form a die cavity; an injection unit mounted to the frame and adapted to be connected to a molten magnesium supply means, the injection unit having a nozzle and being adapted to inject molten magnesium from the supply means into the die cavity through the nozzle for casting a piece; and a relative displacement configuration between the table and the injection unit such that the die sections on the table are engageable with the nozzle of the injection unit at the parting line of the die sections for casting of a product in said die cavity, and such that the die sections on the table are disengageable from the nozzle for ejection of the casted product from the die cavity.

According to a further broad aspect of the present invention, there is provided a method for die casting magnesium pieces with a multiple-slide die-casting machine of the type having an injection unit and at least two slides mounted to a table, the table and the injection unit being relatively displaceable with respect to one another, the slides having die sections and being actuatable in a close/open action to form a die cavity at a parting line therebetween, comprising the steps of: closing the die sections to form the die cavity; engaging a nozzle of the injection unit with the parting line of the die sections by relative displacement of the table with respect to the injection unit, such that the nozzle is in fluid communication with the die cavity; injecting molten magnesium in the die cavity wherein the molten magnesium will solidify in the die cavity to form a magnesium cast product; disengaging the die cavity from the nozzle of the injection unit by relative displacement between the table and the injection unit; and opening the die sections to release the magnesium cast product.

According to a still further broad aspect of the present invention, there is provided a die-casting machine comprising: a frame; a table having pivoting means so as to be pivotally mounted to the frame; a slide guiding mechanism secured to the table and having at least two slides, each said slide having a die section at an operating end thereof, the at least two slides being actuatable in a close/open action such that the die sections mate at a parting line therebetween to form a die cavity; an injection unit fixed to the frame and adapted to be connected to a molten medium supply means, the injection unit having a nozzle and being adapted to inject molten medium from the supply means into the die cavity through the nozzle for casting a piece; and actuation means to displace the table with respect to the injection unit for engagement of the die sections with the nozzle at the parting line for injection of molten medium in the die cavity to cast a product, and for disengagement of the die sections from the nozzle to eject the casted product from the die cavity.

According to a still further broad aspect of the present invention, there is provided an injection unit for a hot-chamber die-casting machine, comprising: a gooseneck injector having a base portion at a first end of the gooseneck injector and adapted to receive a molten medium supply, a nozzle at a second end of the gooseneck injector adapted to inject the molten medium supply in a die cavity, a channel between the base portion and the nozzle adapted for conveying the molten medium supply therethrough, and a piston chamber in the base portion actuatable to draw the molten medium supply therein and to direct the molten medium supply in the channel for injection into said die cavity; an actuation portion connected to the gooseneck injector to actuate the piston chamber; and heating cartridges received in the gooseneck injector adjacent to the channel to control a temperature of the molten medium supply in the channel.

BRIEF DESCRIPTION OF THE DRAWINGS

A preferred embodiment of the present invention will now be described with reference to the accompanying drawings in which.

DESCRIPTION OF THE PREFERRED EMBODIMENTS

Figure 1:
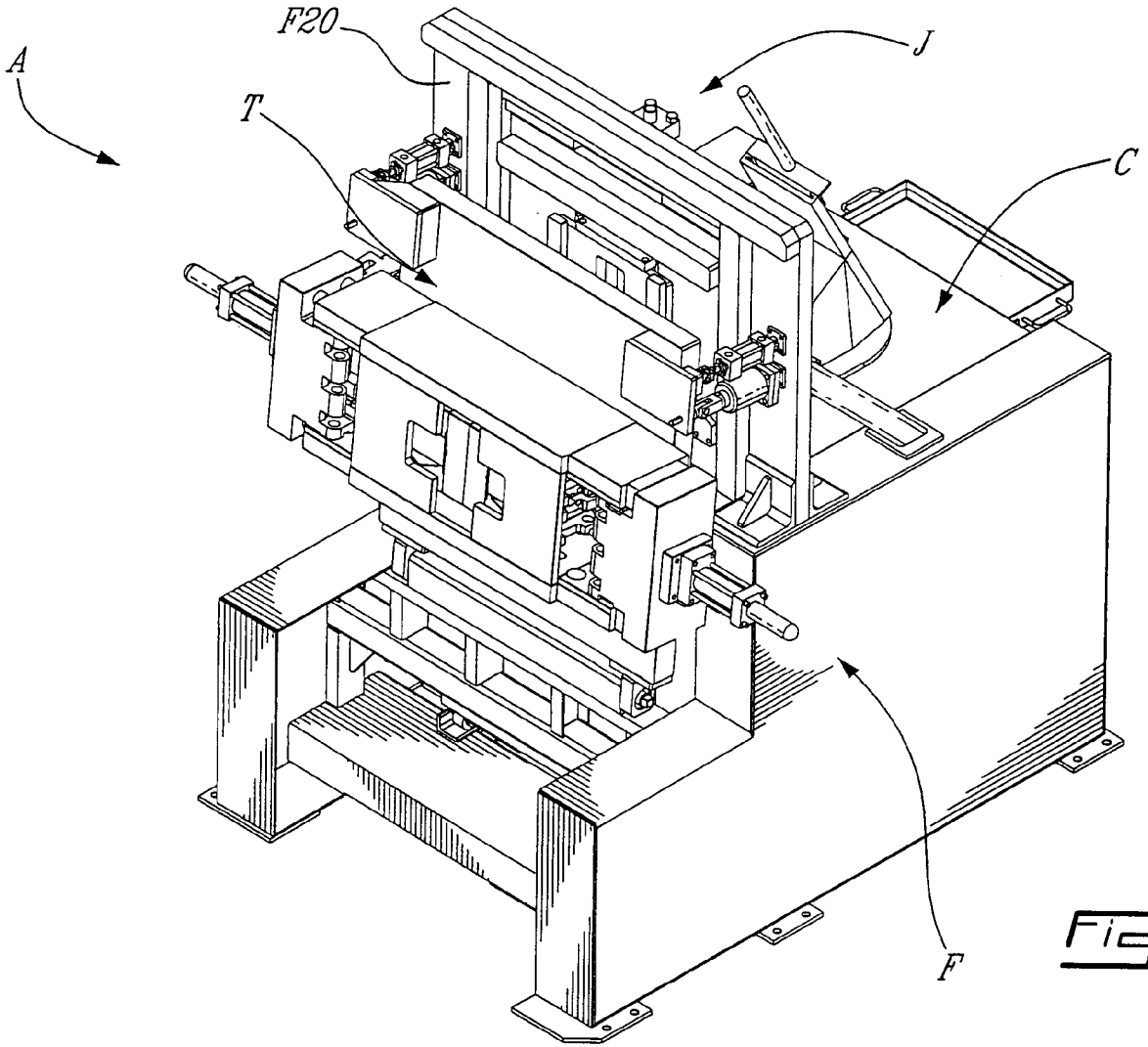
FIG. 1 is a front right-side perspective view of a die-casting machine constructed in accordance with the present invention.
Figure 2:
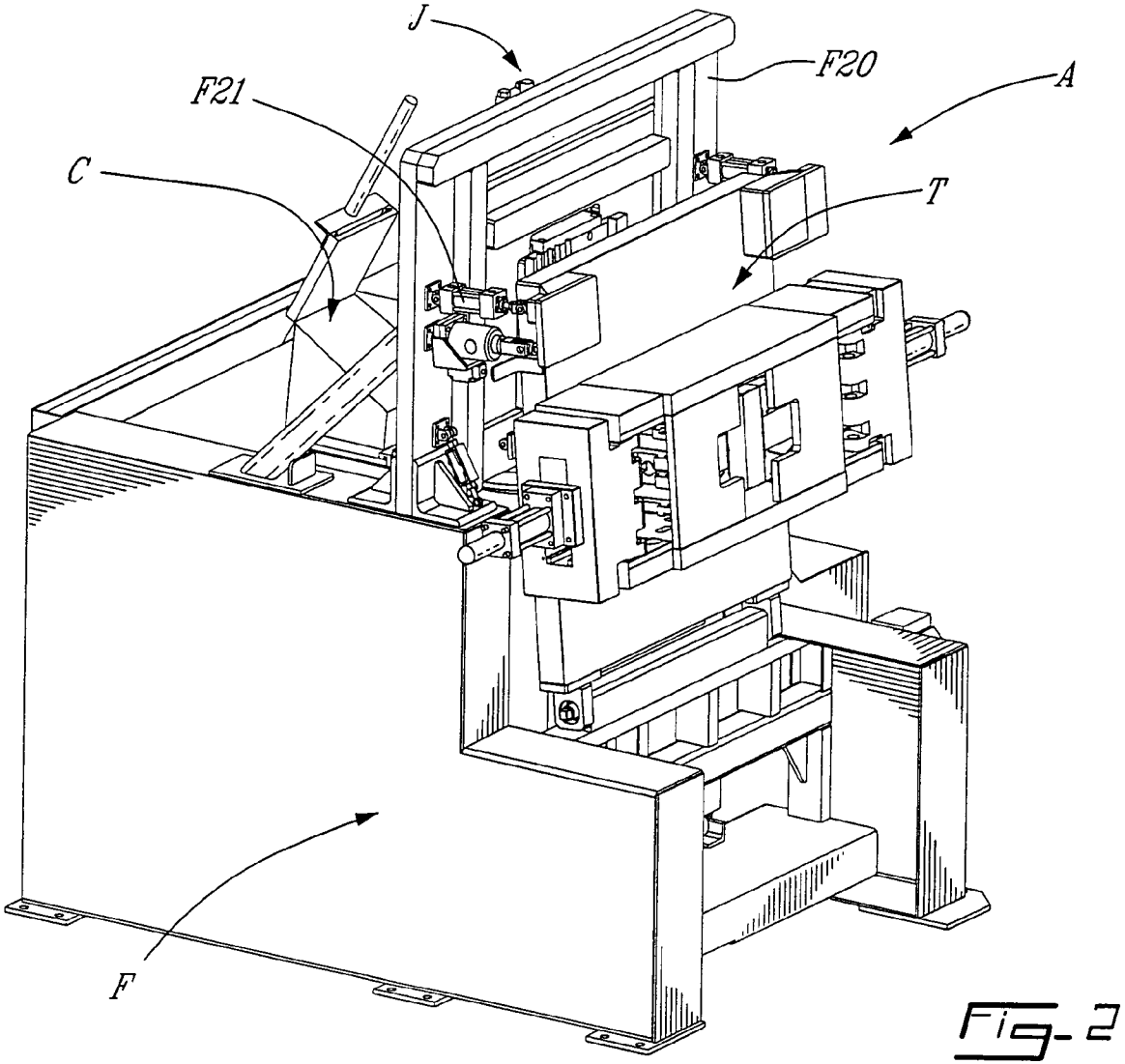
FIG. 2 is a front left-side perspective view of the die-casting machine.
Figure 3:
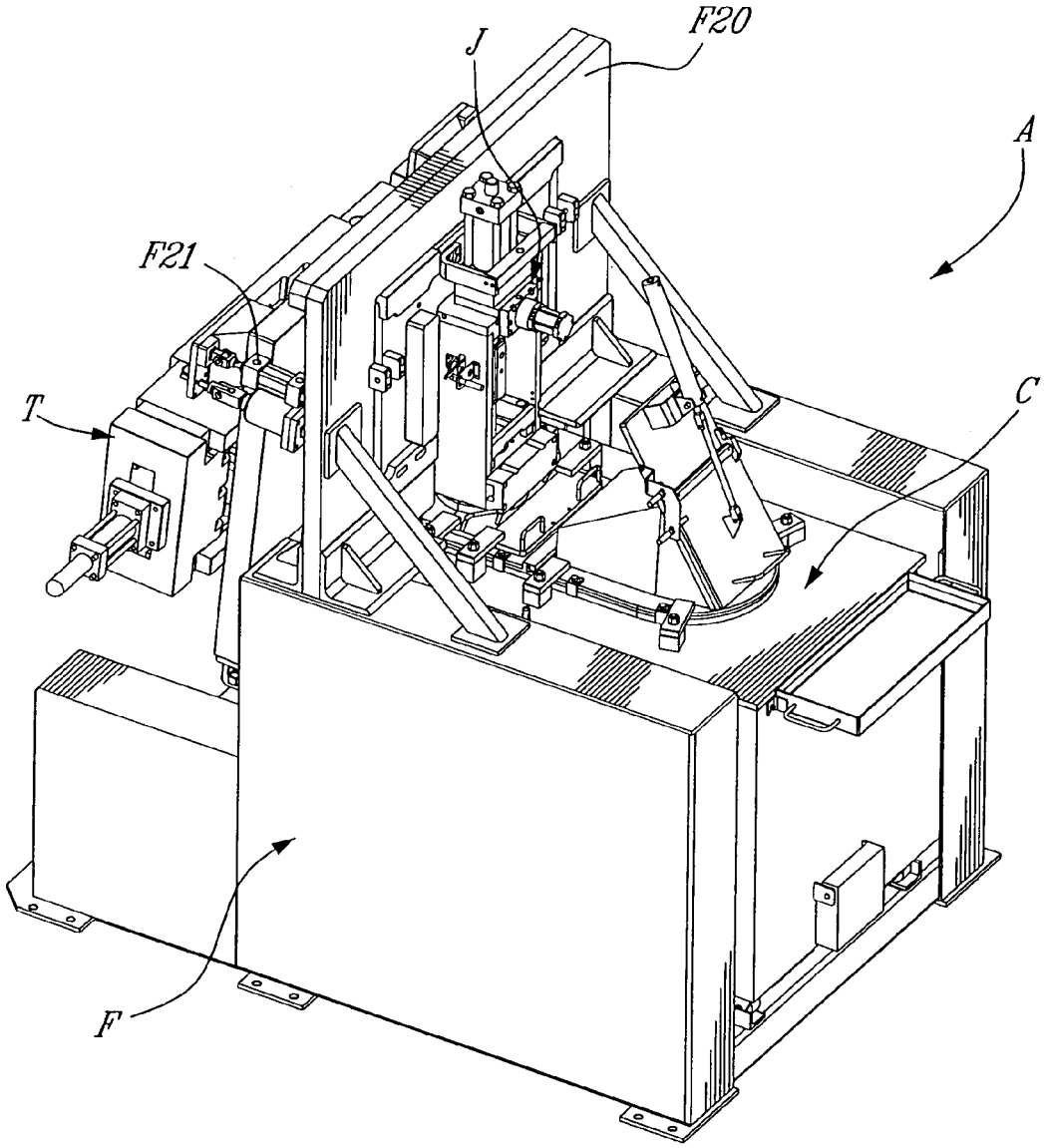
FIG. 3 is a rear right-side perspective view of the die-casting machine.

Referring to the drawings and, more particularly, to FIGS. 1, 2 and 3, a die-casting machine in accordance with the present invention is generally shown at A. The die-casting machine A is configured for parting-line multiple-slide die-casting. The die-casting machine A consists of four major parts, namely the frame F, the injection unit J, the table T and the hot chamber C (i.e., the furnace). As will be described hereinafter, although the die-casting machine A is shown having a hot chamber C in FIGS. 1, 2 and 3, the die-casting machine A can be adapted for cold-chamber die-casting.

The frame F is the structure for the die-casting machine A. The injection unit J and the table T are supported by the frame F, so as to be cooperative. When supported by the frame F, the injection unit J is also operatively connected to the hot chamber C. For simplicity purposes, components of the frame F referred to in the present description and drawings will be prefixed with the letter "F."

The injection unit J supplies casting medium from the hot chamber C to the table T. For simplicity purposes, components of the injection unit J referred to in the present description and drawings will be prefixed with the letter "J."

The table T comprises the slide guiding mechanism, including the slides, which are actuatable to form the die cavity with die portions. The injection unit J is positioned at a parting line of the die portions with respect to the table T. The multiple slides are actuated in a close/open action in a die-casting cycle for casting followed by ejection of the cast product. For simplicity purposes, components of the table T referred to in the present description and drawings will be prefixed with the letter "T."

The hot chamber C has a furnace in which casting medium is liquefied prior to casting. The hot chamber C ensures that the casting medium, in its highly reactive liquid state, is isolated from property-altering reactions, e.g., oxidation, and from air moisture. For simplicity purposes, components of the hot chamber C referred to in the present description and drawings will be prefixed with the letter "C."

Vectors will be referred to throughout the present description and drawings to illustrate the operative relations between the components of the die-casting machine A. The vectors will be prefixed with the letter "V."

Die-Casting Cycle

Figure 6A:
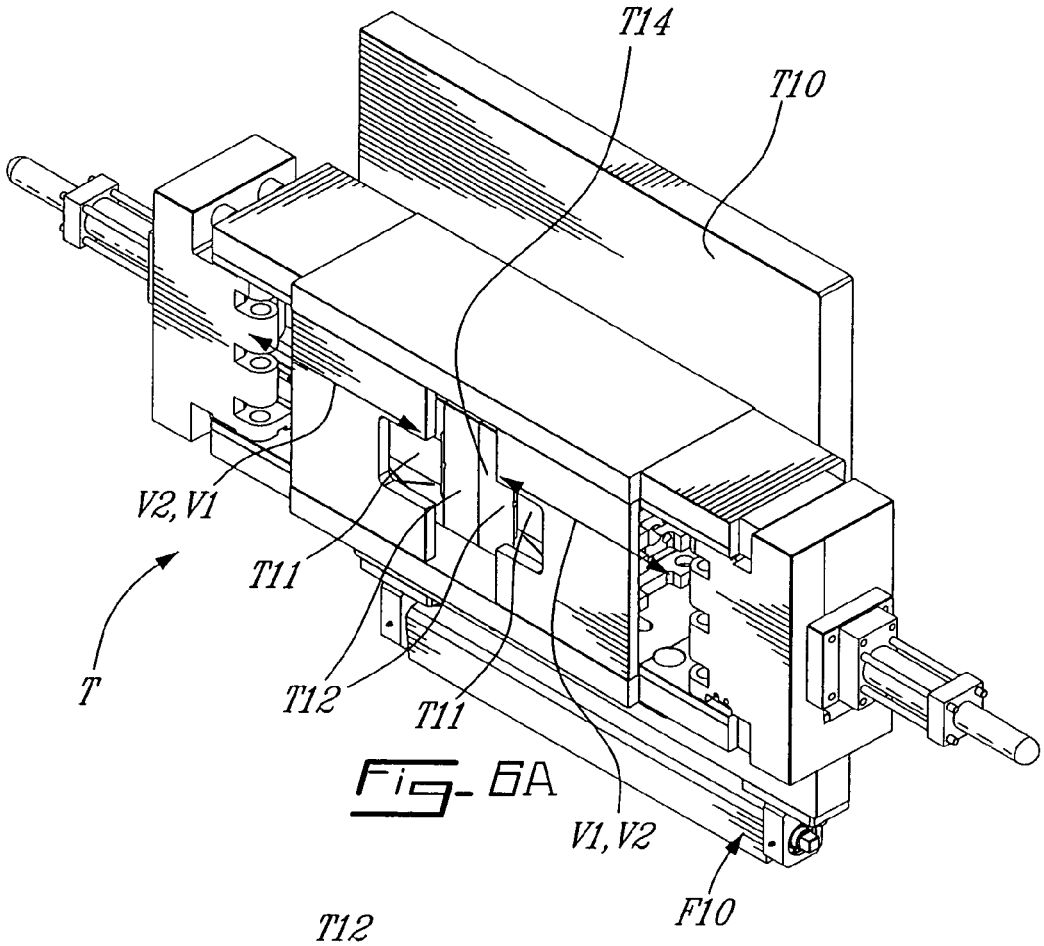
FIG. 6A is a front right-side perspective view of the table of the die-casting machine, with the slide guiding mechanism.
Figure 6B:
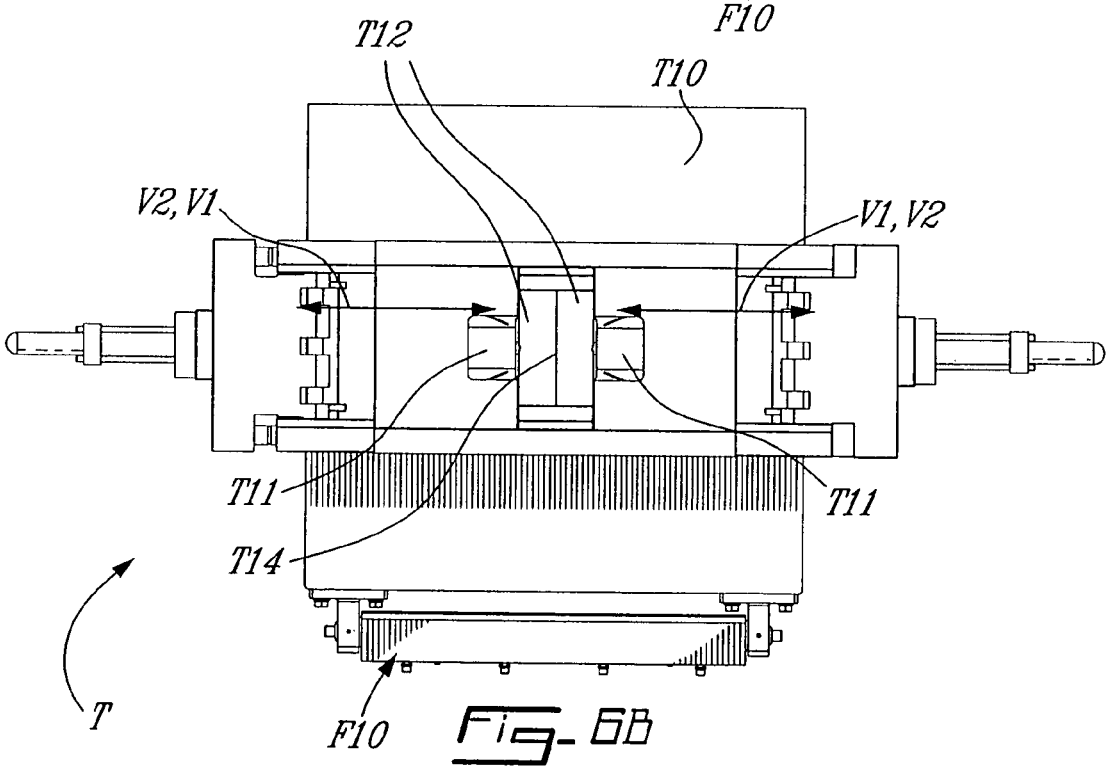
FIG. 6B is a front elevational view of the table of the die-casting machine, with the slide guiding mechanism.

Referring to FIGS. 6A and 6B, the table T is illustrated having a table portion T10 with two slides T11. Obviously, the table T may be equipped with more than two slides, e.g., four slides T11 (positioned in a cross) with two horizontally displaceable slides and two vertically displaceable slides, part of the slide guiding mechanism. The slides T11 are operatively mounted to the table portion T10, and are thus displaceable in a close/open action as illustrated by vectors V1 and V2.

In a closing action, the slides T11 are actuated so as to bring die portions T12 together at a parting line to form a die cavity in which casting medium will be cast. In an opening action, the slides T11 are displaced away from one another to separate the die portions T12 for ejection of the cast product from the die cavity. In a typical parting-line die-casting cycle:

(1) The slides T11 are closed in the closing action, thereby bringing the die portions T12 together at a parting line;

(2) The table T and the injection unit J are brought together at the parting line between the die portions T12;

(3) A casting medium is injected in the die cavity by the injection unit J;

(4) After a solidification period, the table T and the injection unit J are separated to break off the cast product in the die cavity from the injection unit J; and (5) The slides T11 are opened in the opening action, so as to separate the die portions T12 from one another for the ejection of the cast product from the die cavity.

Figure 4:
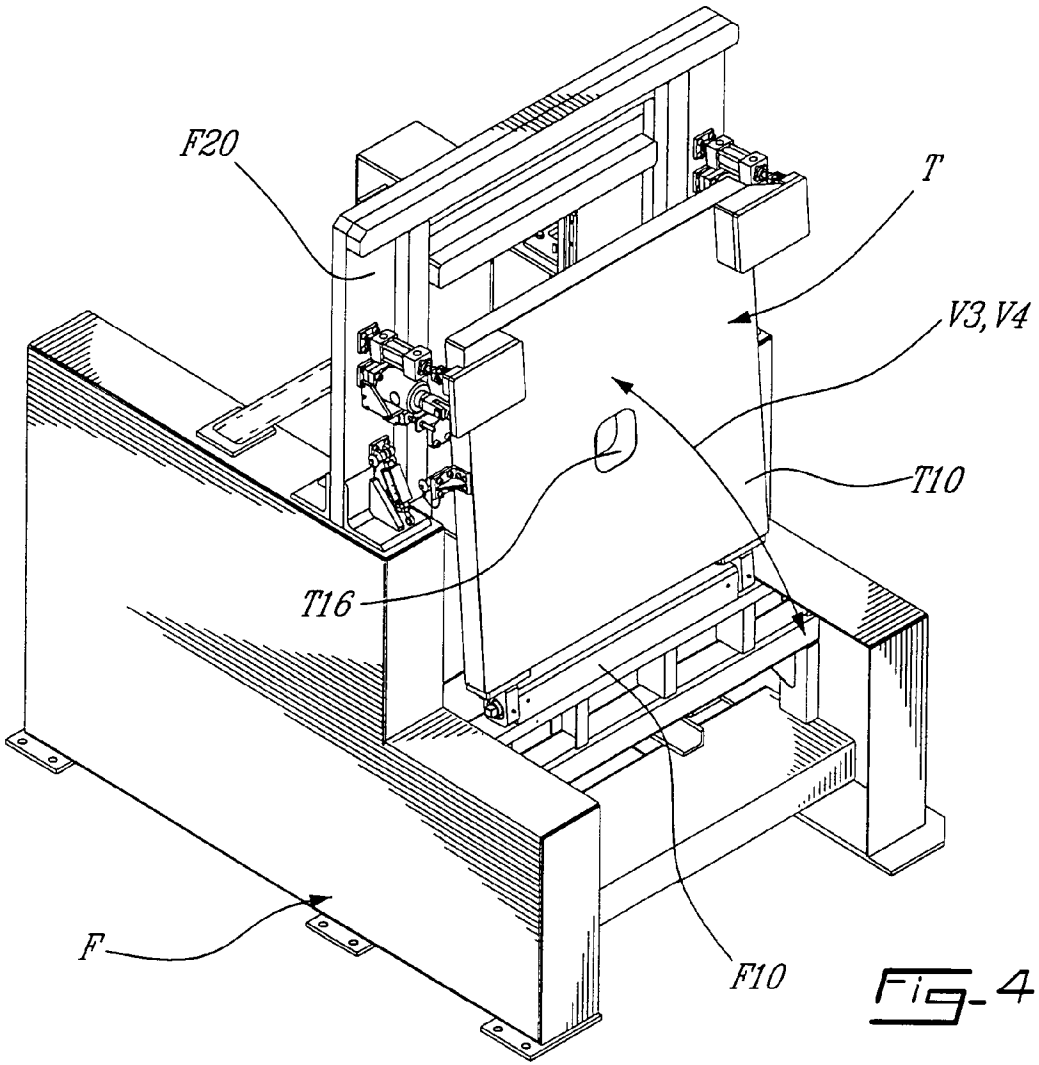
FIG. 4 is a front left-side perspective view of a frame and a table of the die-casting machine, without a slide guiding mechanism.
Figure 13A:
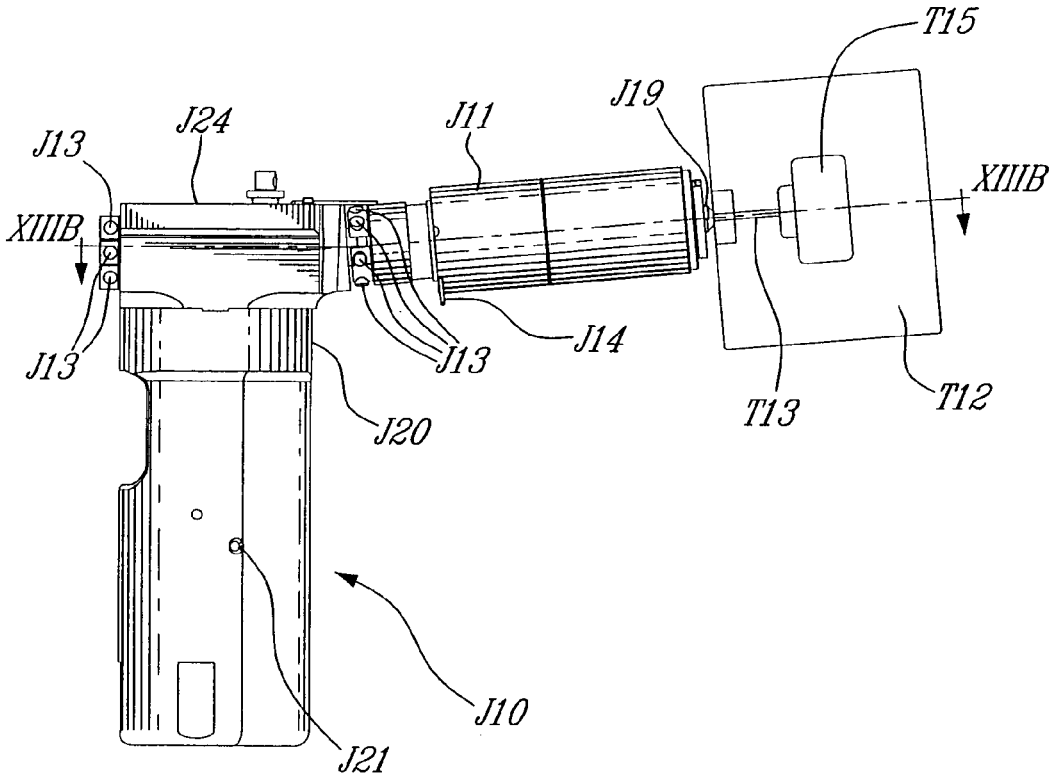
FIG. 13A is a side elevational view of a gooseneck in a casting position with a die.
Figure 13B:
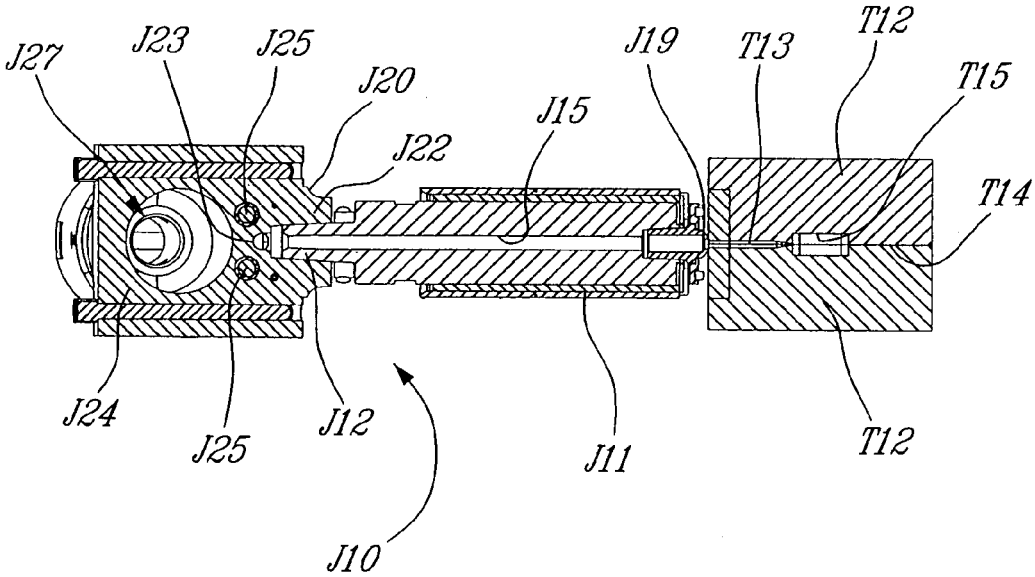
FIG. 13B is across-sectional view of the gooseneck and the die taken along cross-sectional line XIIIB—XIIIB.

Referring to FIGS. 13A and 13B, the die portions T12 are shown in a casting position, i.e., abutted against a gooseneck unit J10 (hereinafter gooseneck J10) of the injection unit J. The gooseneck J10 has a tip J19 thereof aligned with a channel T13 formed by the die portions T12 at the parting line T14. The channel T13 forms a conveying passage to the die cavity T15 (i.e., the cavity in which the casting medium is molded), through which casting medium is fed from the injection unit J to the die cavity T15. As illustrated in FIG. 4, the table portion T10 has an opening T16, through which the nozzle adapter J11 passes to abut against the die portions.

Relative Motion Between the Table T and the Injection Unit J

In the above-described steps (2) and (4) of the typical parting-line die-casting cycle, relative motion must be performed between the table T and the injection unit J. In the preferred embodiment of the present invention, the table T is displaceable with respect to the frame F, so as to meet the injection unit J, which is stationary on the frame F, thereby not disturbing the surface of the molten metal bath in the hot chamber C.

Figure 5B:
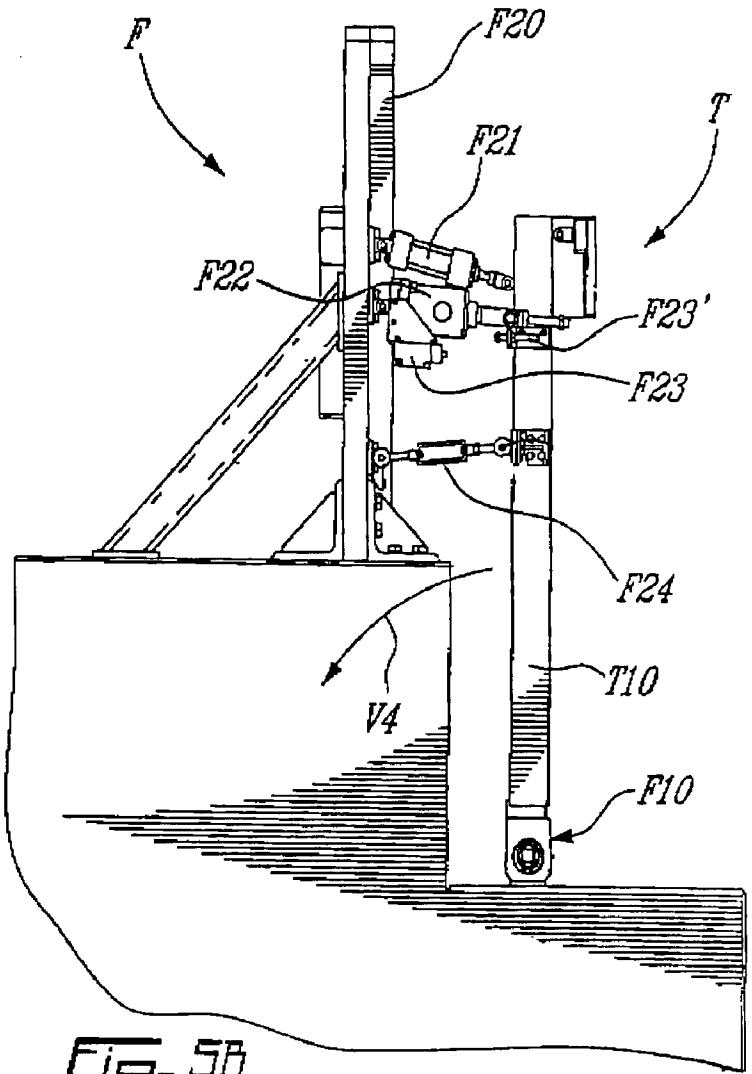
FIG. 5B is a side elevational view of the table of FIG. 4 being pivotally adjusted with respect to the frame of the die-casting machine.
Figure 5A:
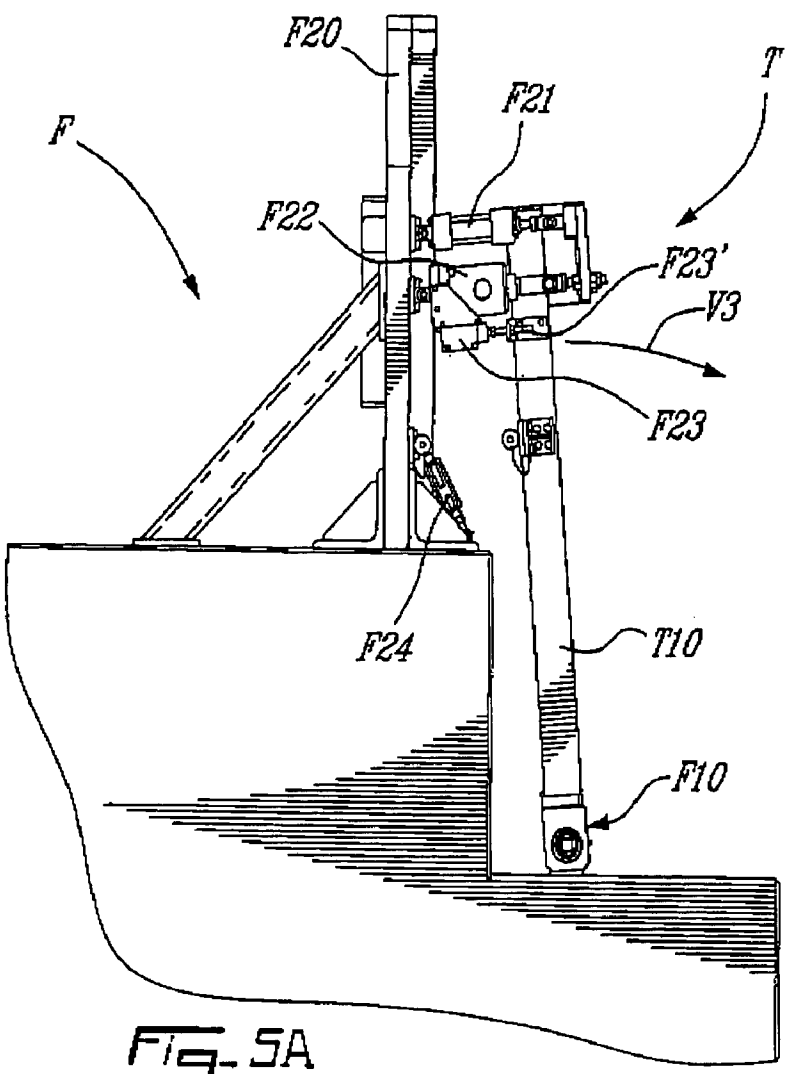
FIG. 5A is a side elevational view of the table of FIG. 4, on the frame of the die-casting machine.

Referring to FIGS. 4, 5A and 5B, the table T is pivotally mounted to the frame F. Accordingly, the table T can perform motions illustrated by vectors V3 and V4 with respect to the frame F. It is pointed out that the table T is illustrated without slides thereon for clarity purposes.

Figure 7:
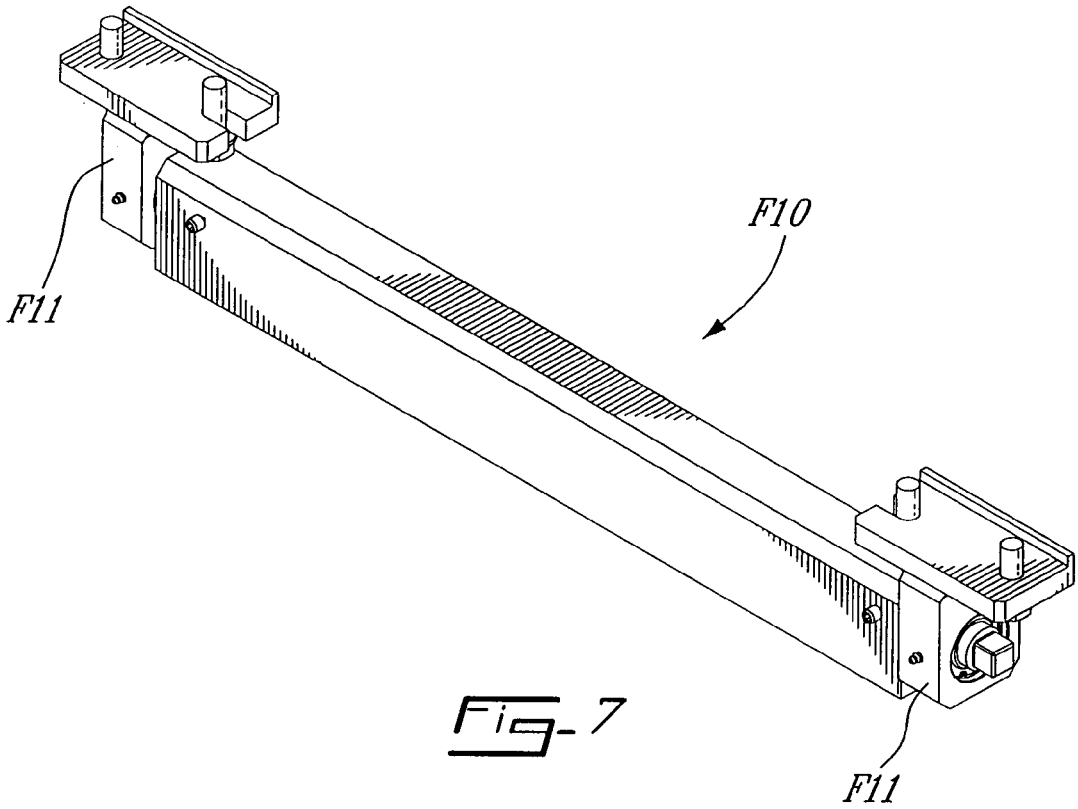
FIG. 7 is a perspective view of a pivot mechanism of the frame of the die-casting machine.
Figure 8:
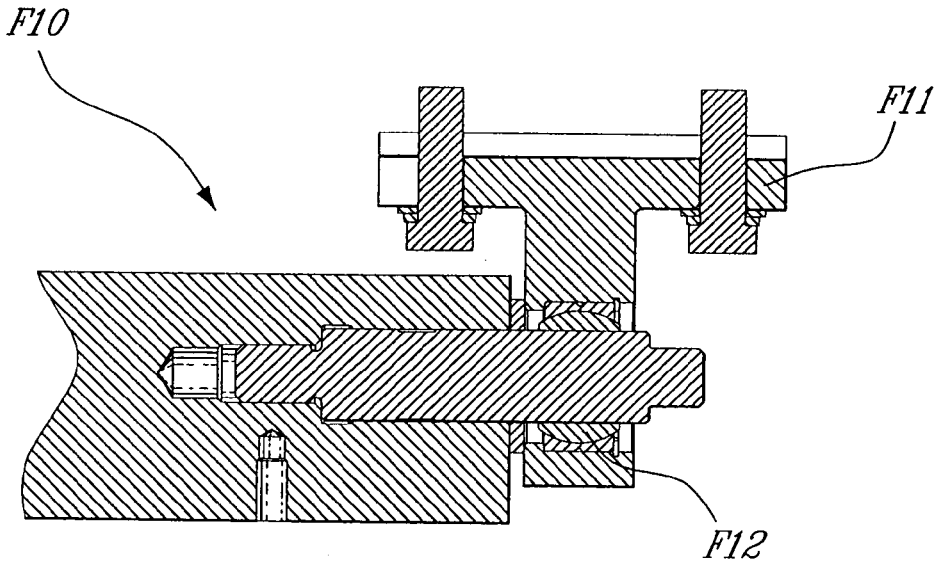
FIG. 8 is a cross-sectional view, fragmented, of a table connector of the pivot mechanism.

More precisely, the frame F has a pivot mechanism F10 by which the table portion T10 is pivotally supported by the frame F. The pivot mechanism F10 is best illustrated in FIGS. 7 and 8, and has an elongated body at ends of which table connectors F11 are pivotally mounted. A bottom edge of the table portion T10 sits on the table connectors F11, which have fasteners to secure the table portion T10 thereto. As shown in FIG. 8, the table connectors F11 have spherical bearings F12 (only one of which is shown). Although the table T is pivoted in one degree of freedom (one DOF) with respect to the frame F, three DOFs are provided so as to compensate for misalignments of the table T on the pivot mechanism F10. Accordingly, 3-DOF bearings will have a greater life in supporting the table T than would 1-DOF bearings.

Referring generally to FIG. 3 and more specifically to FIGS. 5A and 5B, the frame F has an arch structure F20 (hereinafter arch F20). The arch F20 is an upstanding structure of the frame F that will support the injection unit J and the pivoting actuation group for the pivoting displacement of the table T with respect to frame F and the injection unit J.

The pivoting actuation group has pivoting actuators F21 that interconnect the arch F20 to the table portion T10. The pivoting actuators F21 are typically hydraulically, pneumatically, or electrically actuated cylinders that will pivot the table T between the casting position, illustrated in FIG. 5A, and a break-off position (not shown). The table T is illustrated in FIG. 5B in a maintenance position with respect to the frame F, as will be described hereinafter. In the preferred embodiment of the present invention, two pivoting actuators are provided. The pivoting actuators F21 are pivotally secured to both the arch F20 and the table T, to be in accordance with the pivoting motion therebetween, illustrated by vectors V3 and V4.

The pivoting actuation group is also preferably provided with shock absorbers F22, to dampen the movement of the table T, especially toward the casting position. In the casting position, the table T abuts against the injection unit J. It is therefore desired to have the shock absorbers F22 slowing down the motion of the table T toward the casting position to lessen the impact on the injection unit J. Preferably, the shock absorbers F22 are hydraulic cylinders with controllable flow between chambers thereof to adjust the shock-absorbing action.

Finally, the pivoting actuation group is provided with a limit switch F23 that is secured to the shock absorber F22. The limit switch F23 must be triggered at the casting position of the table T for injection to take place. This safety feature ensures that the table T is in the casting position for injection to occur. An adjustment mechanism F23' is provided to adjust the limit switch F23 with respect to the casting position.

Figure 9A:
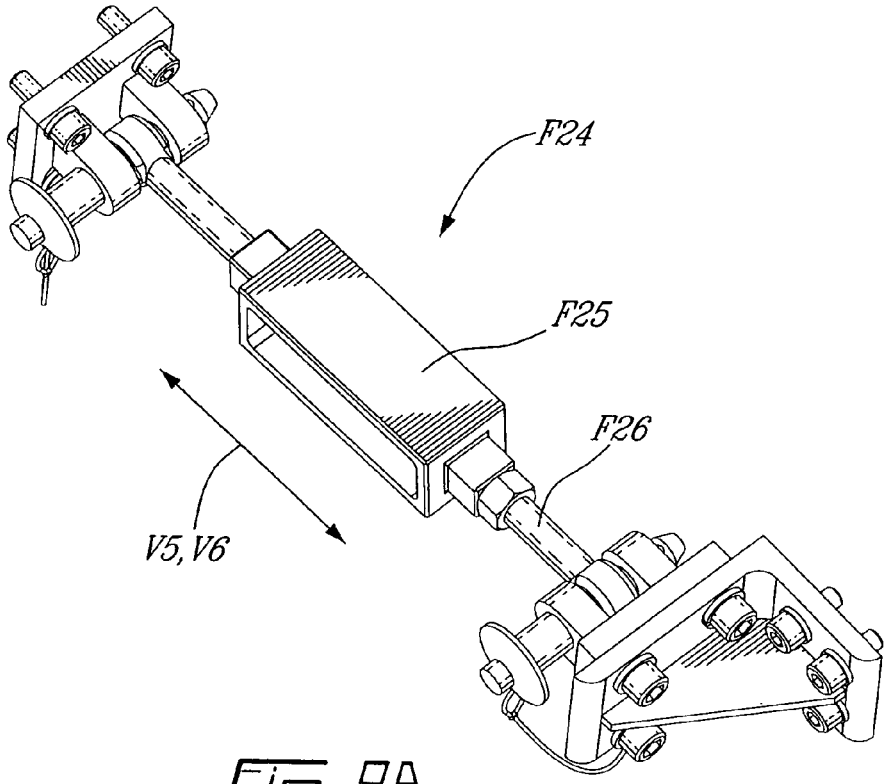
FIG. 9A is a perspective view of an adjustment mechanism of the die-casting machine, for positioning the table in a maintenance position with respect to the frame.
Figure 9B:
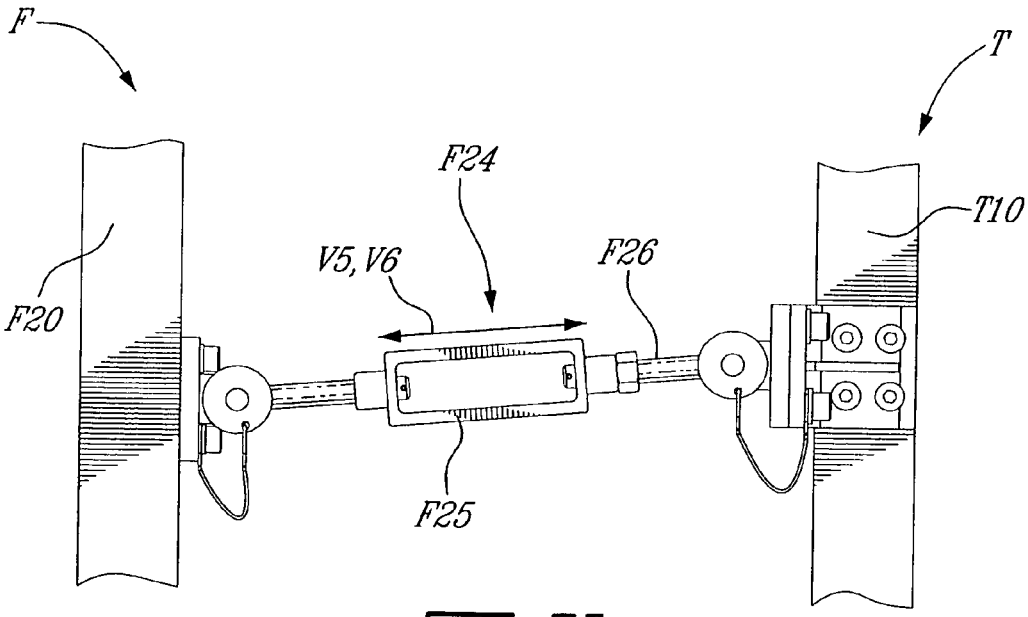
FIG. 9B is a side elevational view of the adjustment mechanism being used between the table and the frame of the die-casting machine.

Referring to FIG. 5B, the table T is shown in a maintenance position with respect to the arch F20, and is held in that position by an adjustment mechanism. The adjustment mechanism F24 is a turnbuckle, as illustrated in FIGS. 9A and 9B. The turnbuckle is pivotally connected to the arch F20 and the table portion T10. The turnbuckle can change length, i.e., in the direction of vectors V5 and V6 (FIG. 9A). This is performed by adjusting the position of the buckle portion F25 with respect to the threaded portion F26. The pivotal connection between the turnbuckle, the arch F20 and the table portion T10 transforms the translation resulting from the change in length of the turnbuckle to the pivoting displacement of the table T with respect to the pivot mechanism F10, i.e., in the direction of vectors V3 and V4 (FIG. 4). As shown in FIG. 5B, the pivoting actuators F21 and shock absorber F22 are disconnected so as not to impede the pivoting of the table portion T10 toward the maintenance position.

Other configurations are contemplated for the displacement between the table T and the injection unit J. For instance, the pivot mechanism F10 could be positioned on the arch F20 such that the table portion T10 would be pivoting about a top edge thereof. In such a configuration, the pivoting actuation group would interconnect the frame F to a bottom portion of the table T. However, it is advantageous to have the pivoting mechanism F10 below the table T, as the center of gravity of the table T is horizontally closer to the pivoting axis when the pivoting mechanism F10 is at the bottom. This has a direct effect on the sizing of the components of the pivoting actuation group. Also, if the center of mass of the table T is below the pivoting mechanism, the components of the pivoting actuation group must support the weight of the table T in displacing it between positions, which is not so with the opposite, whereby the components must be specified for greater loads.

In another configuration, a translation system could be provided for the relative displacement of the table T with respect to the injection unit J.

The Injection Unit J

Referring to FIGS. 14A, 14B, 18A and 18B, the injection unit J generally consists of two major components, namely, the injection portion, including the gooseneck J10 and the nozzle adapter J11, and an actuation portion J30. The nozzle adapter J11 is secured to a top end of a base portion J20 of the gooseneck J10. More precisely, the nozzle adapter J11 receives a feed of casting medium from the base portion J20 and supplies the die cavity T15 therewith. As shown in FIGS. 13A, 13B, 17A and 17B, the nozzle adapter J11 has a tip J19 thereof that abuts against the die portions T12. The nozzle adapter J11 has a generally cylindrical body with a longitudinal channel J15 generally concentric with the cylindrical body. An opposed end of the nozzle adapter J11 has a connector J12 by which the nozzle adapter J11 is releasably connectable to the base portion J20.

As the casting medium is in a molten state, the temperature differential between the inner walls that define the channel J15 of the nozzle adapter J11 and the casting medium must be controlled to avoid solidification of the casting medium in the channel J15. Accordingly, a plurality of heating cartridges J13 extend longitudinally in the cylindrical body, generally parallel to the channel J15, but radially spaced therefrom. Thermocouples J14 are also provided in the cylindrical body to measure the temperature, such that the temperature can be controlled.

Referring to FIGS. 13A, 13B, 14A and 14B, the base portion J20 of the gooseneck J10 has an upstanding cylindrical portion that is adapted to be received in a bath of molten casting medium, to extract the medium therefrom through inlet J21. The base portion J20 preferably has a single-piston configuration. An expansion of a piston chamber will cause an injection of the medium in the piston chamber from the molten metal bath. Thereafter, a compression of the piston chamber will cause the medium to be conveyed to the die cavity T15 through the nozzle adapter J11.

The base portion J20 has a connector J22 on a box-shaped head portion J24 at an outlet thereof, by which it is matingly coupled to the connector J12 of the nozzle adapter J11. When the nozzle adapter J11 is coupled to the base portion J20 to form the gooseneck J10, a channel J23 (FIG. 13B), extending from the piston chamber to the connector J22, is operatively aligned with the channel J15 of the nozzle adapter J11 to form a continuous channel through which the casting medium is conveyed to the die cavity T15.

Figures 14A, 14B, 15A, 15B:
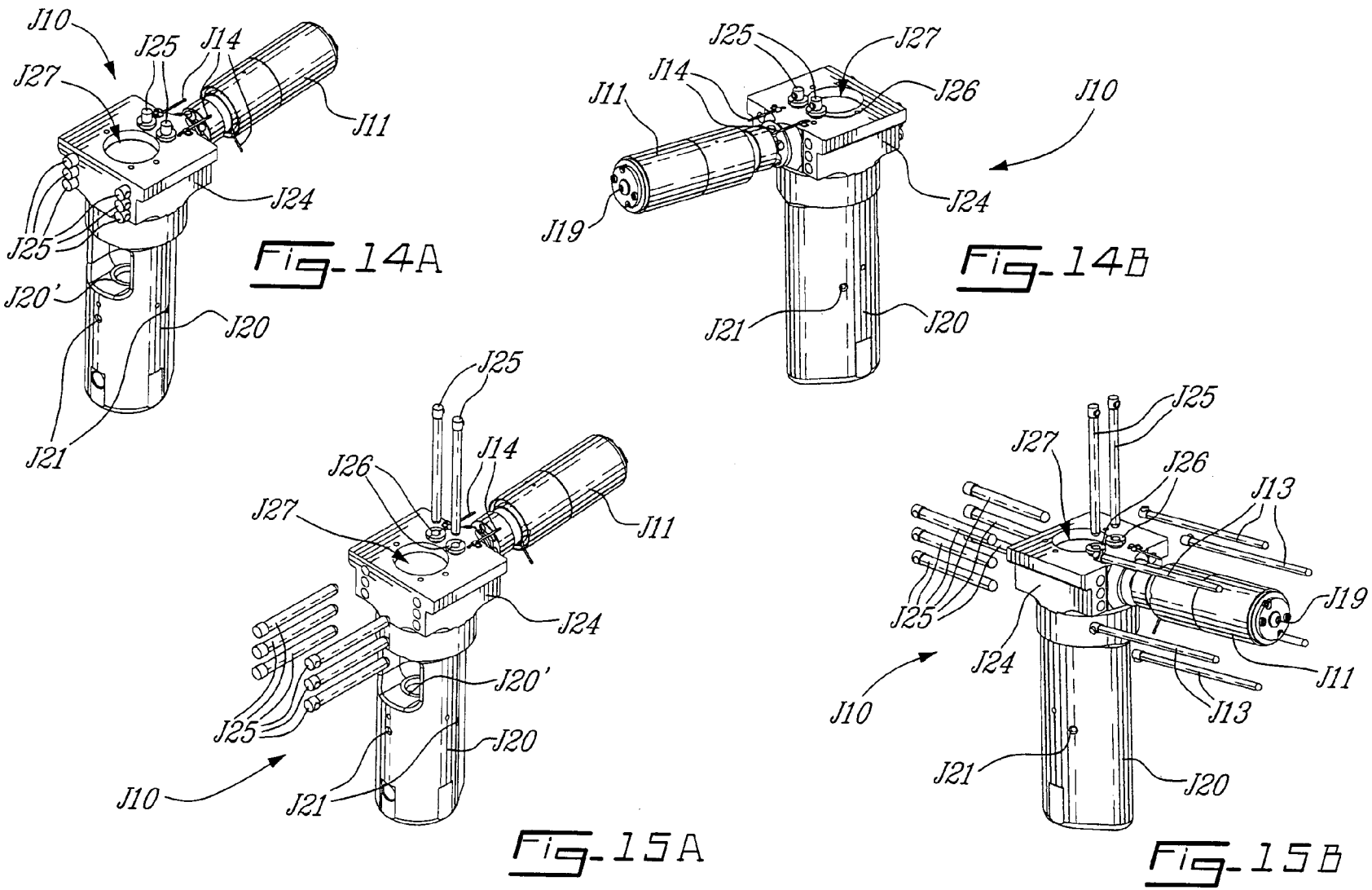
FIG. 14A is a rear left-side perspective view of the gooseneck.
FIG. 14B is a front right-side perspective view of the gooseneck.
FIG. 15A is a rear left-side exploded view of the gooseneck and heating cartridges thereof.
FIG. 15B is a front left-side exploded view of the gooseneck with the heating cartridges thereof.

The base portion J20 of the gooseneck J10 is equipped with a sleeve J20' (FIGS. 14A and 15A) defining the piston chamber, in which the injection piston slides. The sleeve J20' is removable from the base portion J20 such that it can be replaced by a new sleeve when the sleeve J20' becomes worn. It is pointed out that in prior art goosenecks, a bore or a non-removable sleeve in the base portion defines the piston chamber. The bore or sleeve must be resurfaced according to various techniques (e.g., re-boring, honing) as it wears out after a given number of casting cycles, and the injection piston and rings thereof must be modified as a result of diametrical changes to the bore, after the gooseneck has been removed from the die-casting machine. The removable feature of the sleeve J20' thus substantially decreases the time required to repair the gooseneck J10. Access is provided at a bottom end of the base portion J20 to press the sleeve J20' out of the base portion J20. The sleeve J20' can exit through the opening J27 in the head portion J24 (FIGS. 14A and 15A). Moreover, as the internal diameter of the new sleeve is the same that the previous sleeve J20', the process parameters of the die-casting operation remain essentially constant, whereas with the injection units of the prior art, the internal diameter of the bore or sleeve is increased at each re-boring, which progressively reduces the metal pressure at injection, for any given pressure in the hydraulic system.

Figure 12:
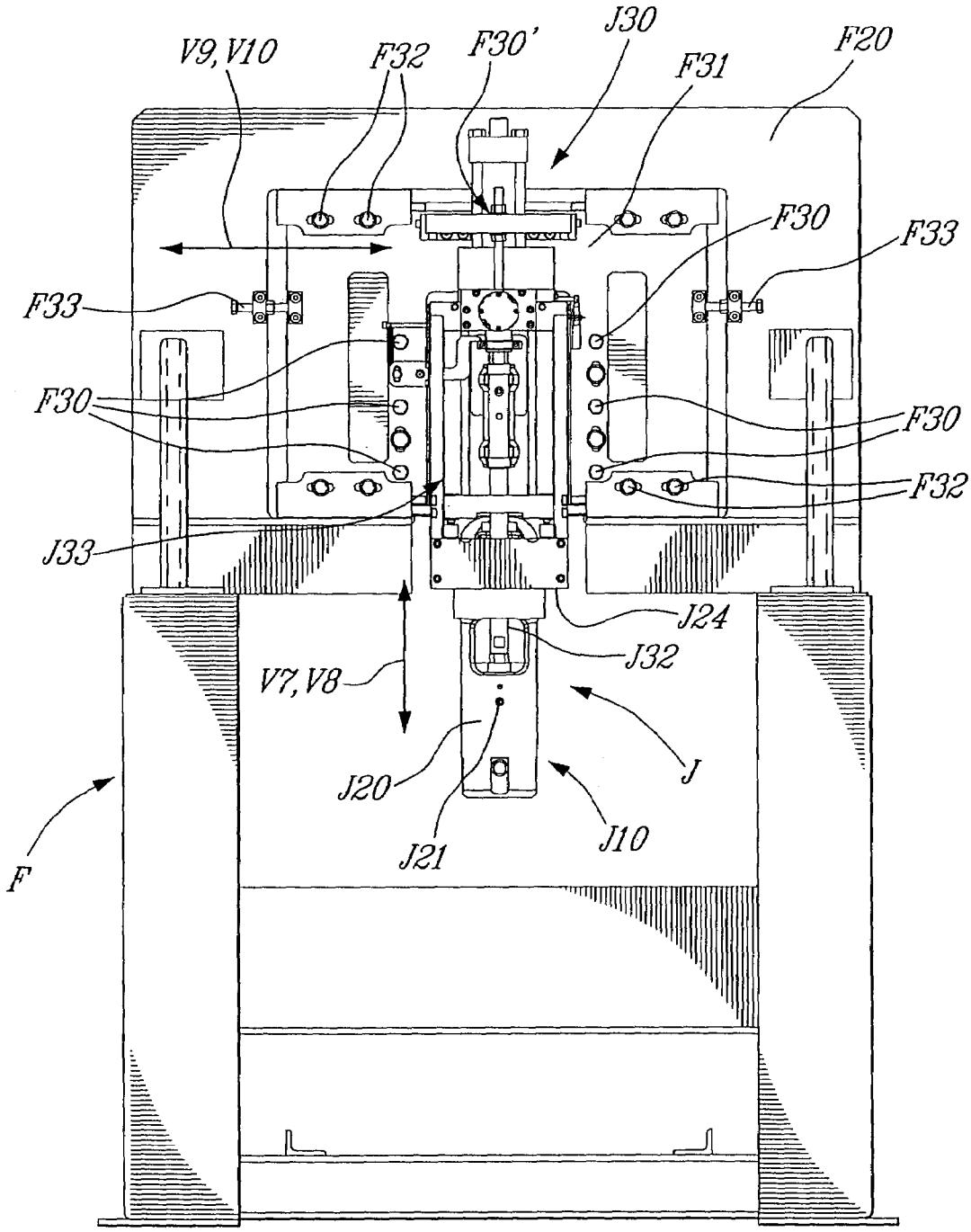
FIG. 12 is a rear elevational view of the injection unit and frame of FIG. 10.

Referring to FIGS. 12, 15A and 15B, the head portion J24, by which the gooseneck J10 is connected to the actuation portion J30, is shown having heating cartridges J25 that will heat the base portion J20 to prevent medium solidification in the channel J23. The vertical cartridges J25 are positioned in flanged-head sleeves J26 that will facilitate their removal from the gooseneck J10. Thermocouples J14 are provided to control the temperature. An opening J27 is defined in the head portion J24, and is provided for receiving an actuation rod of the actuation portion J30 for the actuation of the piston in the base portion J20.

Other suitable heating means can be used to prevent solidification of the medium in the channel J23 of the gooseneck J10. For instance, the gooseneck J10 may be provided with heating conduits in which a heating liquid is conveyed to maintain the surface of the channel J23 at an appropriate temperature, or with any other suitable arrangement, to prevent solidification of magnesium.

Referring to FIGS. 18A, 18B, 19A and 19B, the actuation portion J30 is shown having an actuator J31, in the form of a cylinder. An actuation rod J32 has a threaded end by which it is releasably connectable to the piston J32' of the base portion J20. Therefore, the actuator J31 will displace the piston J32' of the base portion J20, and thus control the injection of casting medium in the die cavity T15 (FIG. 13A).

The actuation portion J30 has a casing that supports both the actuator J31 and gooseneck J10, via the base portion J20. More precisely, a bottom end J33 of the casing defines a shape adapted to cooperatively connect with the head portion J24 of the base portion J20 such that the head portion J24 can slide into engagement with the bottom end J33 and be accurately positioned. A safety cylinder J34 is secured to a top end of the casing and is actuated to lock the actuator J31 when the piston chamber of the piston portion J20 is filled with casting medium. The safety cylinder J34 cooperates with the actuation rod J32 to prevent an unwanted displacement of the actuator J31, especially when the die portions T12 (FIG. 6A) are separated from one another. For instance, the actuation rod J32 can have a sleeve J32" thereon with a throat portion and the safety cylinder, a corresponding fork portion cooperating with the throat portion. A removable transparent door (not shown) is removably secured to the open face of the casing, so as to hermetically close the casing, while allowing to see the movement of the actuation rod J32.

It is pointed out that, although the injection unit J described above has a single-piston configuration, double-piston technology may be used in the die-casting machine A. A double-piston injection unit typically has a first piston provided for conveying molten casting medium from a source to the die, and a second piston provided to block/open the passage between the first piston and the die.

The Injection Unit J on the Frame F

Figure 10:
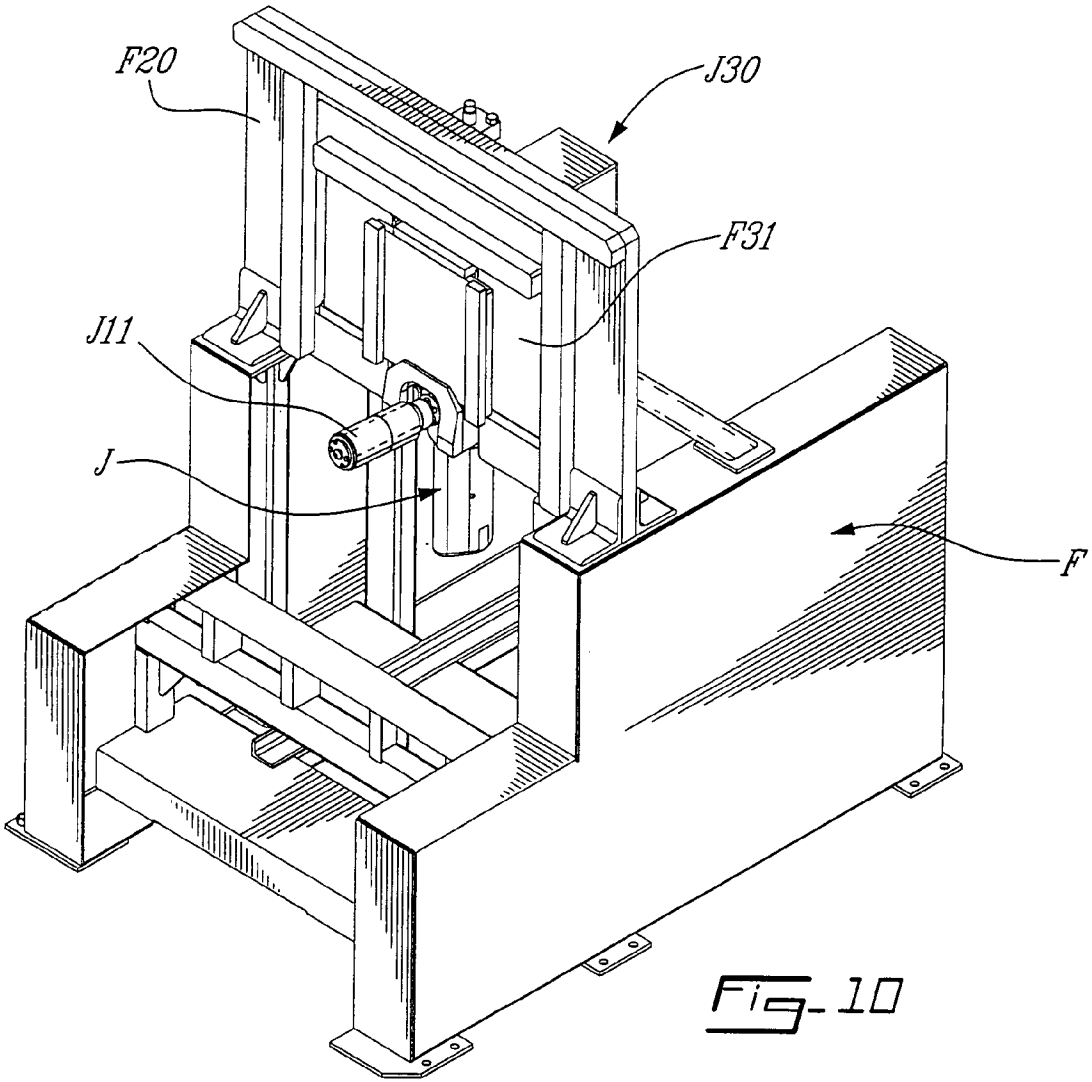
FIG. 10 is a front right-side perspective view of an injection unit secured to the frame.
Figure 11:
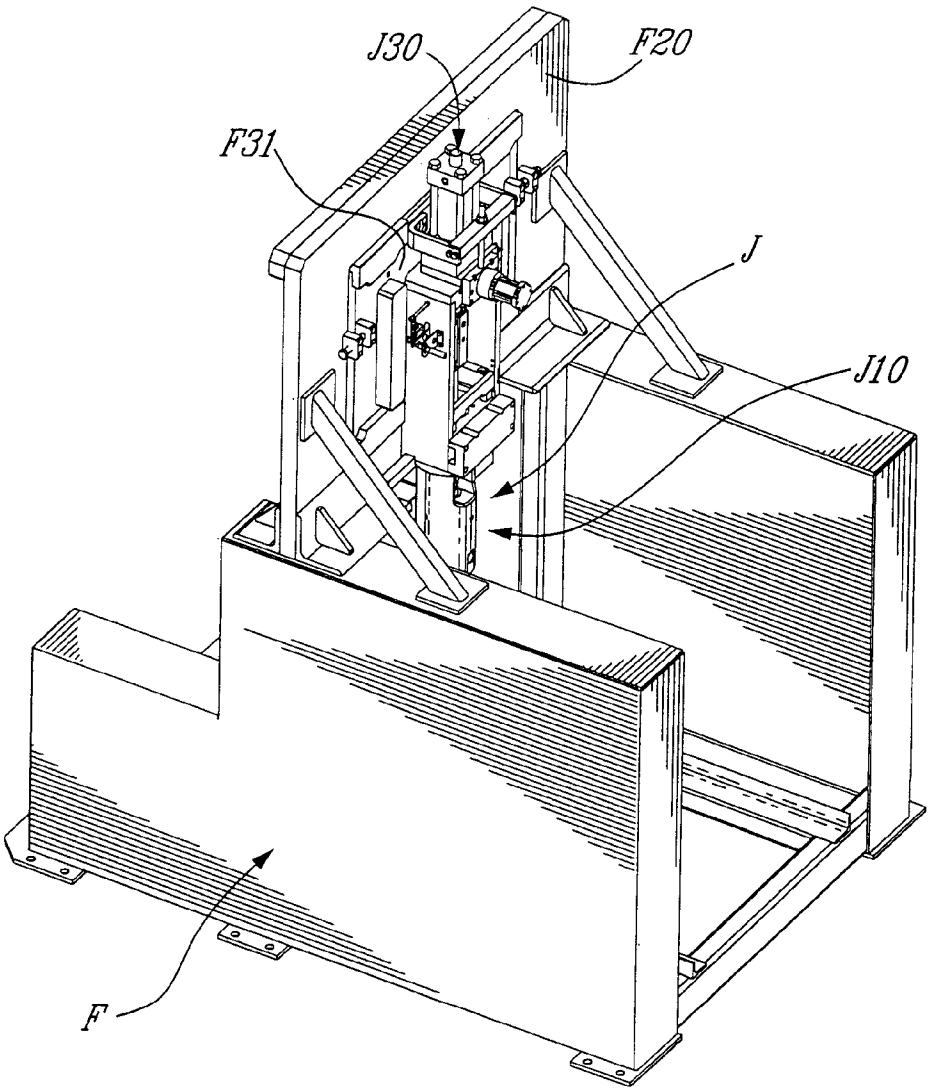
FIG. 11 is a rear right-side perspective view of the injection unit and frame of FIG. 10.

Referring to FIGS. 10, 11 and 12, the injection unit J is secured to the arch F20. In the preferred embodiment of the present invention, the injection unit J is stationary with respect to the frame F, and the table T is pivoted into engagement with the injection unit J during casting cycles. The injection unit J, although being stationary during casting cycles, is secured to the arch F20 so as to be adjustable in the vertical plane of the arch F20. More precisely, two DOFs are provided between the injection unit J and the arch F20, such that the nozzle adapter J11 of the gooseneck J10 can be aligned with respect to the parting line of the die portions T12 of the channel T13 (FIG. 13B). Therefore, in total, three DOFs are provided, if the one DOF of the adjustment mechanism F24 is considered (FIGS. 5A and 5B).

Figure 19B:
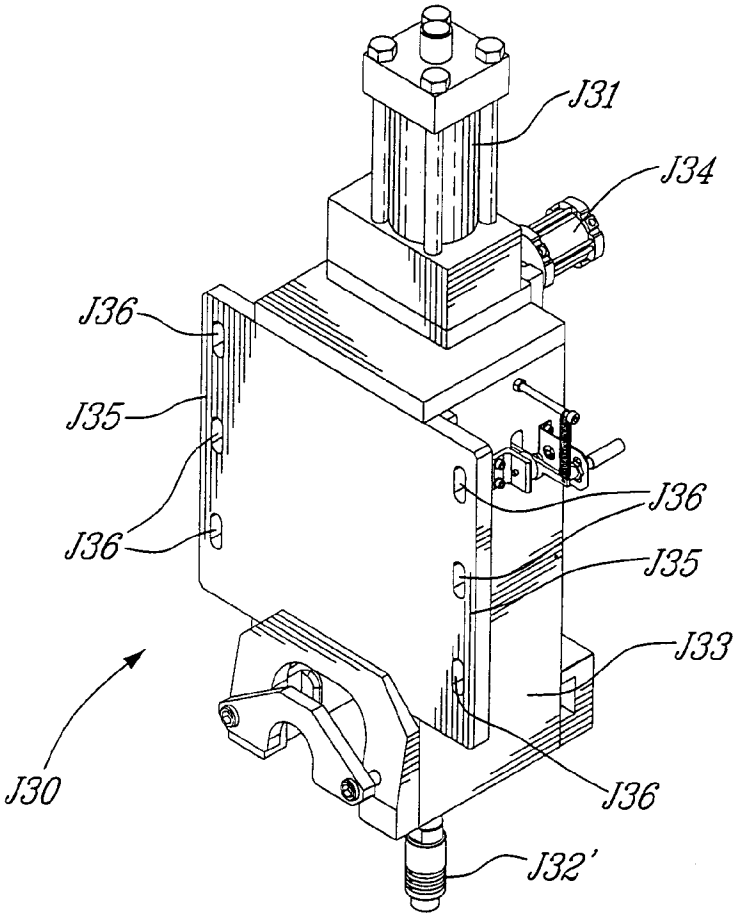
FIG. 19B is a front right-side perspective view of the actuation portion of the injection unit.
Figure 19A:
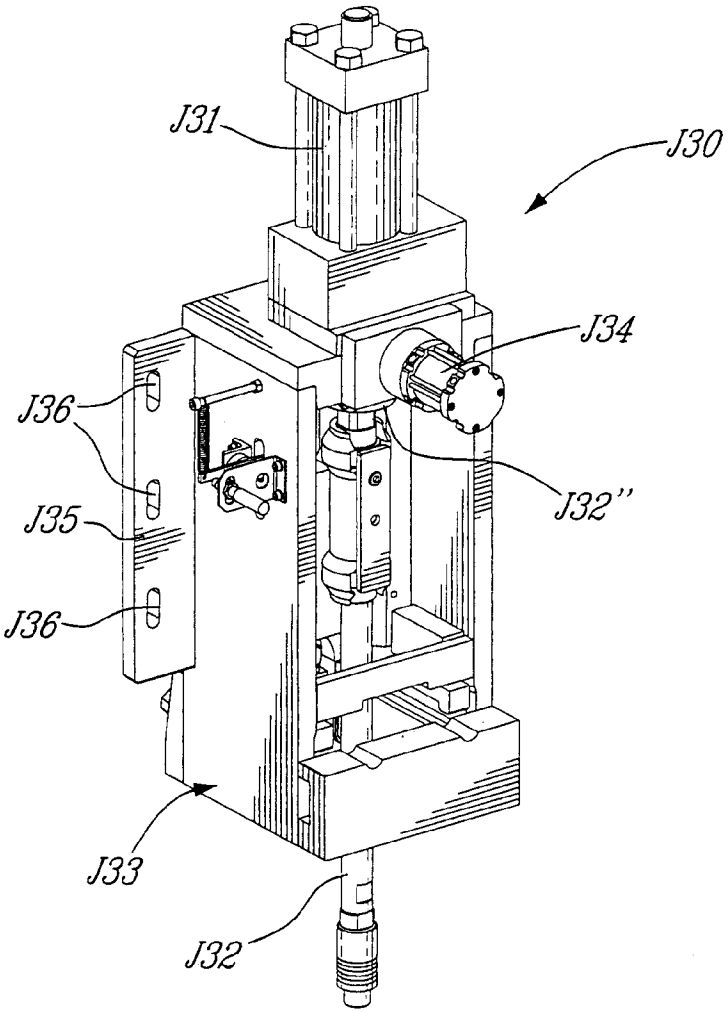
FIG. 19A is a rear right-side perspective view of the actuation portion of the injection unit.

As shown in FIG. 12, vectors V7 and V8 illustrate the direction of the first adjustment DOF, whereas vectors V9 and V10 show the direction of the second adjustment DOF. The casing of the actuation portion J30 has a pair of flanges J35 having oblong holes J36 (FIGS. 19A and 19B). The injection unit J is secured to the arch F20 by the pair of flanges J35 being slidingly received in corresponding channels of the arch F20. The sliding engagement therebetween allows the translation of the actuation portion J30 in the direction of vectors V7 and V8. Adjustment mechanism F30' is provided for adjusting the vertical position of the actuator portion J30 with respect to the arch F20. The adjustment mechanism F30' typically consists of a threaded bolt/nut combination for precise positioning of the actuator portion J30. The oblong openings J36 cooperate with fasteners F30 to set the actuation portion J30 in the direction of vectors V7 and V8. The fasteners F30 are manually tightened to exert pressure on the channels receiving the flanges J35.

As best seen in FIG. 12, the arch F20 has a plate F31 that is slidingly moveable in the direction of vectors V9 and V10, with respect to the rest of the arch F20. Fasteners F32 squeeze the plate F31 in position with respect to the rest of the arch F20, and adjustment mechanisms F33 allow the finer adjustment of the horizontal position of the plate F31.

The configuration of the injection unit J allows for the gooseneck J10 to be removed from the arch F20, while the actuation portion J30 remains on the arch F20.

The Hot Chamber C

Figure 16B:
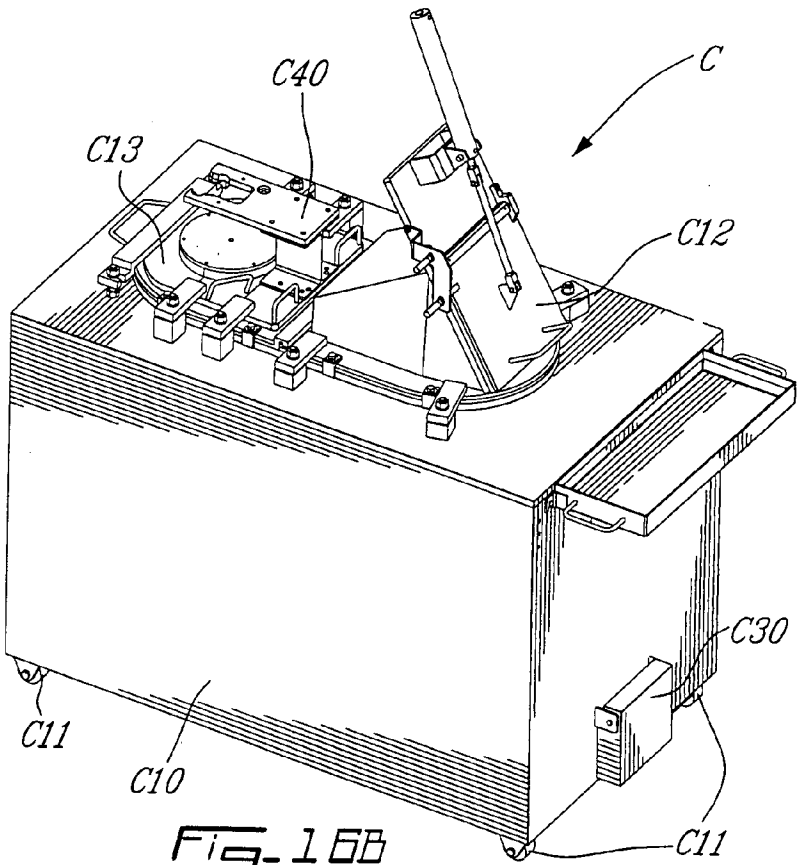
FIG. 16B is a rear right-side perspective view of the hot chamber.
Figure 16A:
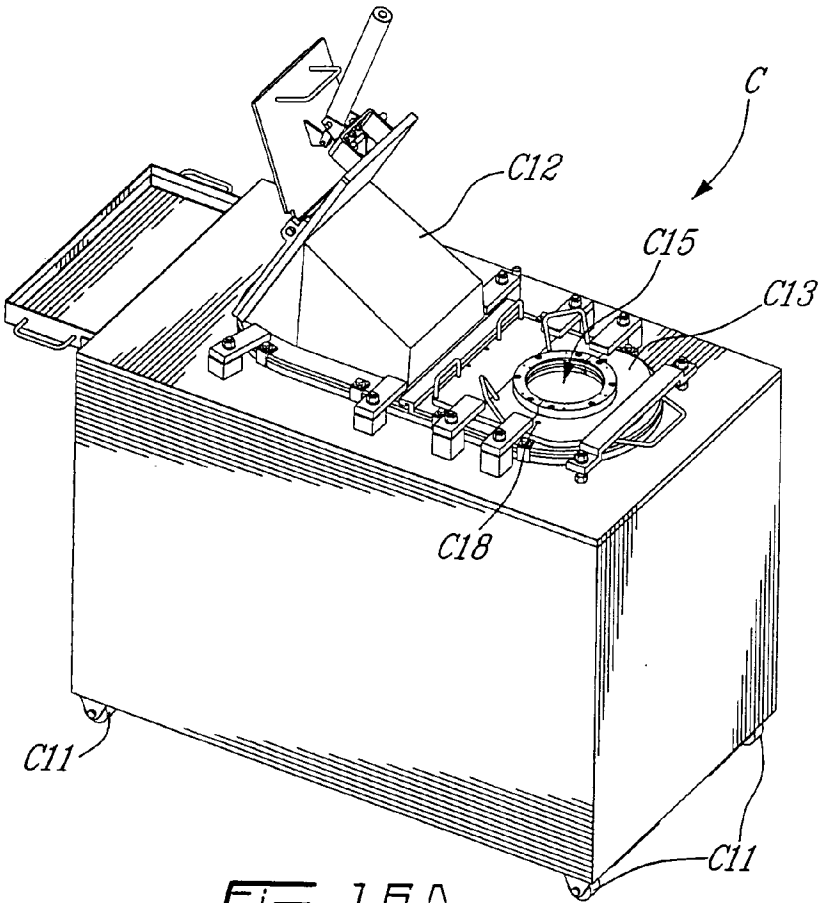
FIG. 16A is a front left-side perspective view of a hot chamber of the die-casting machine of the present invention.
Figure 17A:
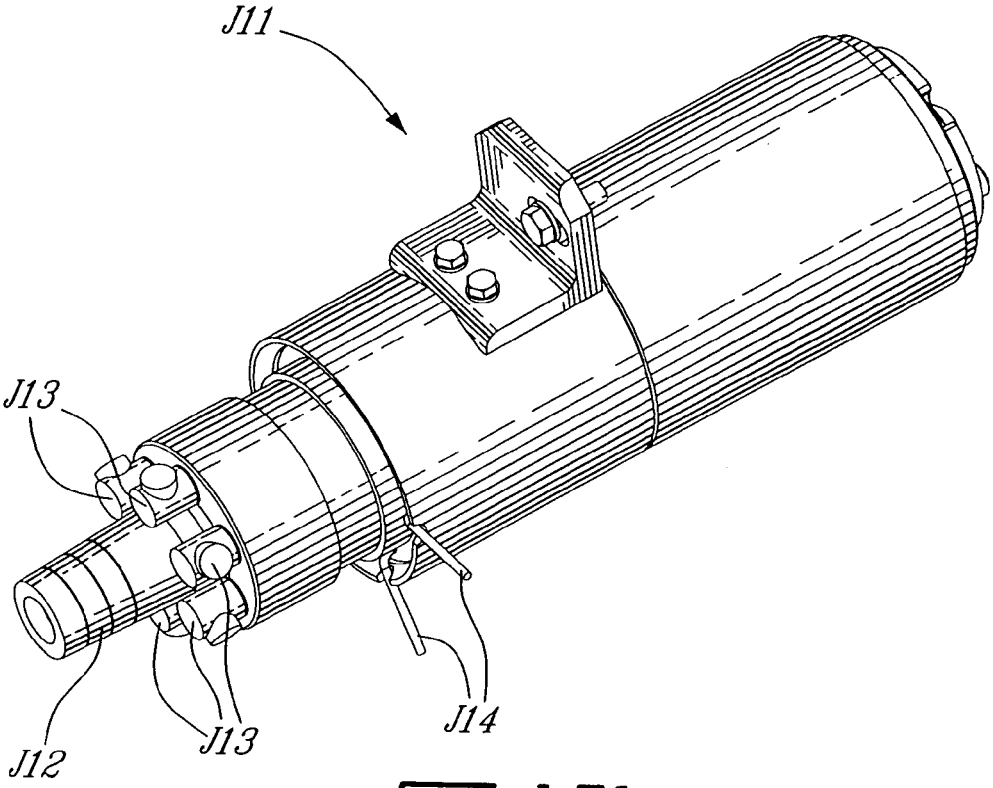
FIG. 17A is a rear left-side perspective view of a nozzle adapter of the gooseneck.
Figure 17B:
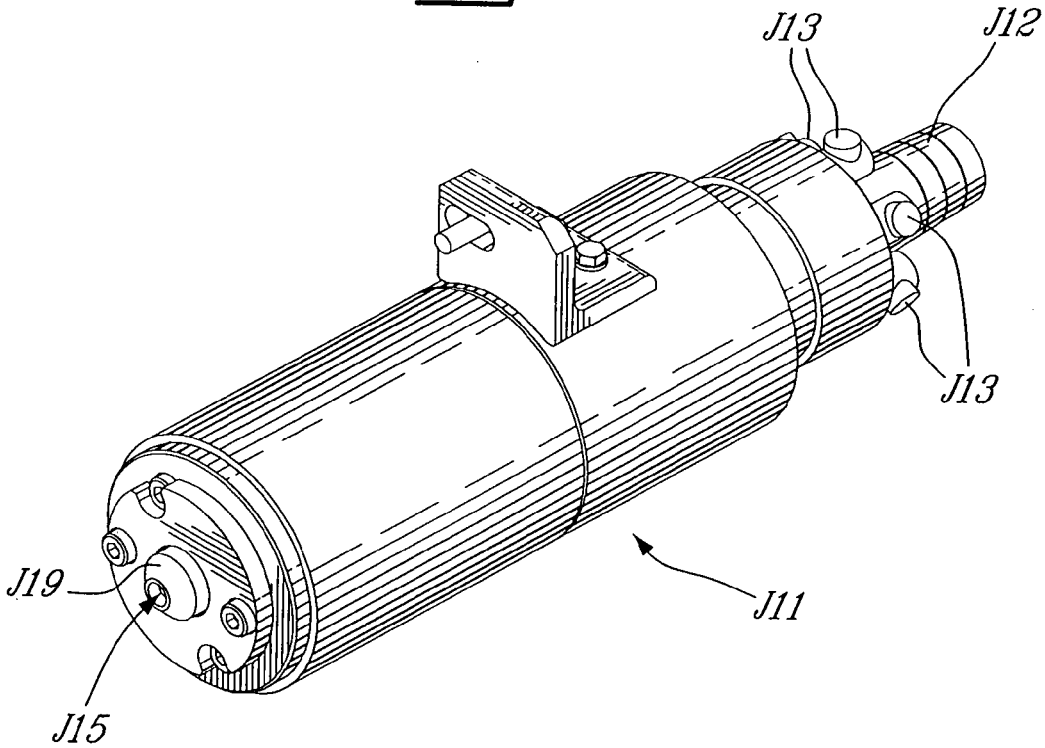
FIG. 17B is a front right-side perspective view of the nozzle adapter.
Figure 21:
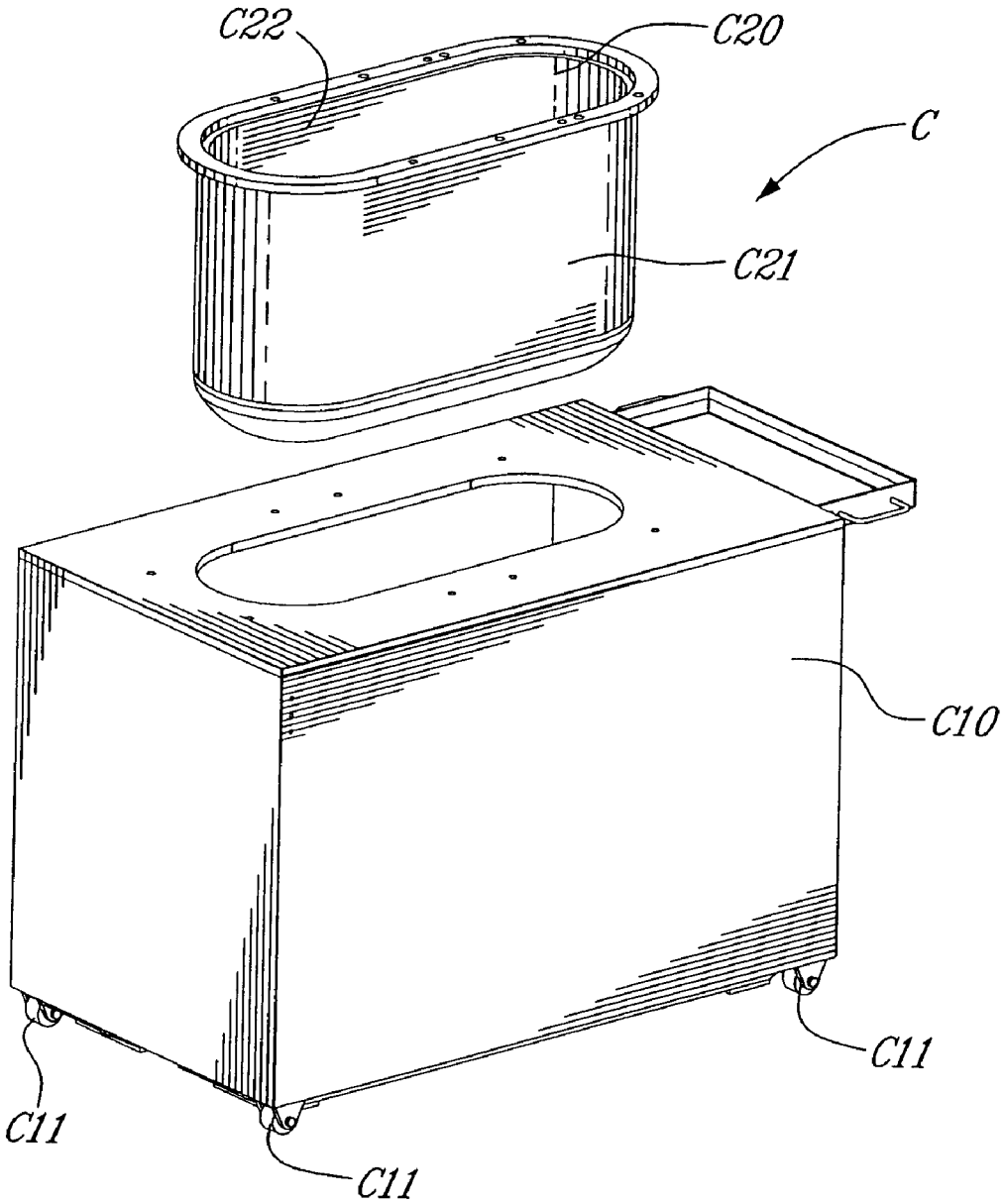
FIG. 21 is an exploded view of a crucible with respect to the hot chamber of the die-casting machine.

Referring to FIG. 3, the hot chamber C is shown in position with respect to the frame F. Referring to FIGS. 16A, 16B and 21, the hot chamber C has a generally box-shaped furnace C10 that is on rollers C11, so as to be displaceable with respect to the frame F. The furnace C10 has a top surface with an opening through which is inserted a crucible C20. When the crucible C20 is in the furnace C10, an access door portion C12 and an injection access portion C13 cover the opening. The molten casting medium in the crucible C20 is in a reactive state. To avoid oxidizing of the molten casting medium, the bath of molten casting medium in the crucible C20 must be exposed as little as possible to ambient air. For instance, a shielding gas is typically used to form a shielding fluid layer on the molten medium bath. It is known to use $SF_6$ mixed with other gases, or any other suitable equivalent as shielding gas.

Figure 20A:
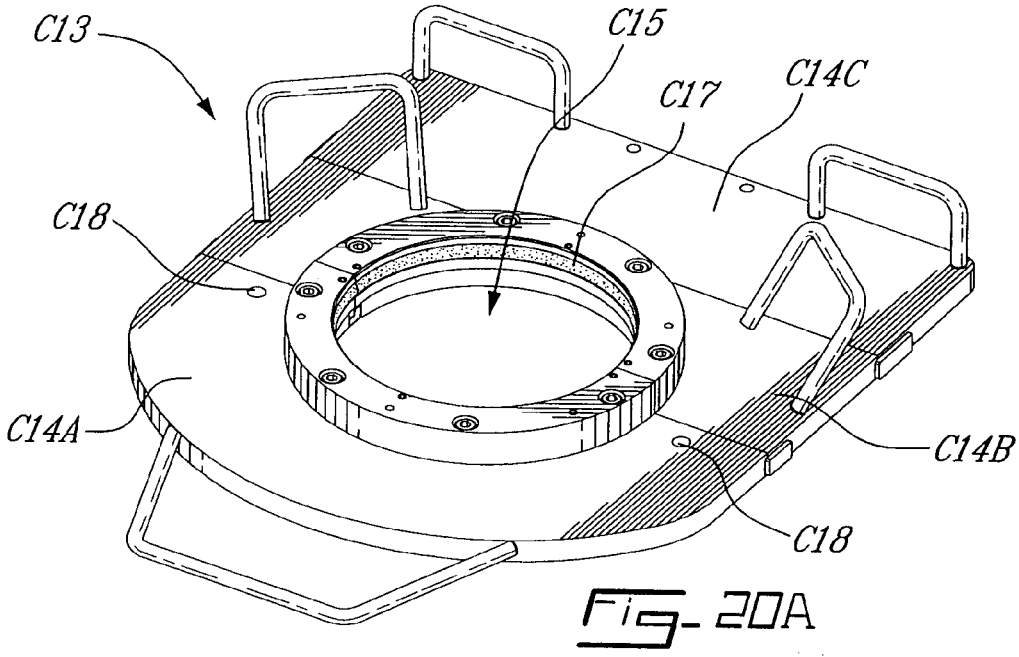
FIG. 20A is a top perspective view of a panel of the hot chamber of the die-casting machine.
Figure 20B:
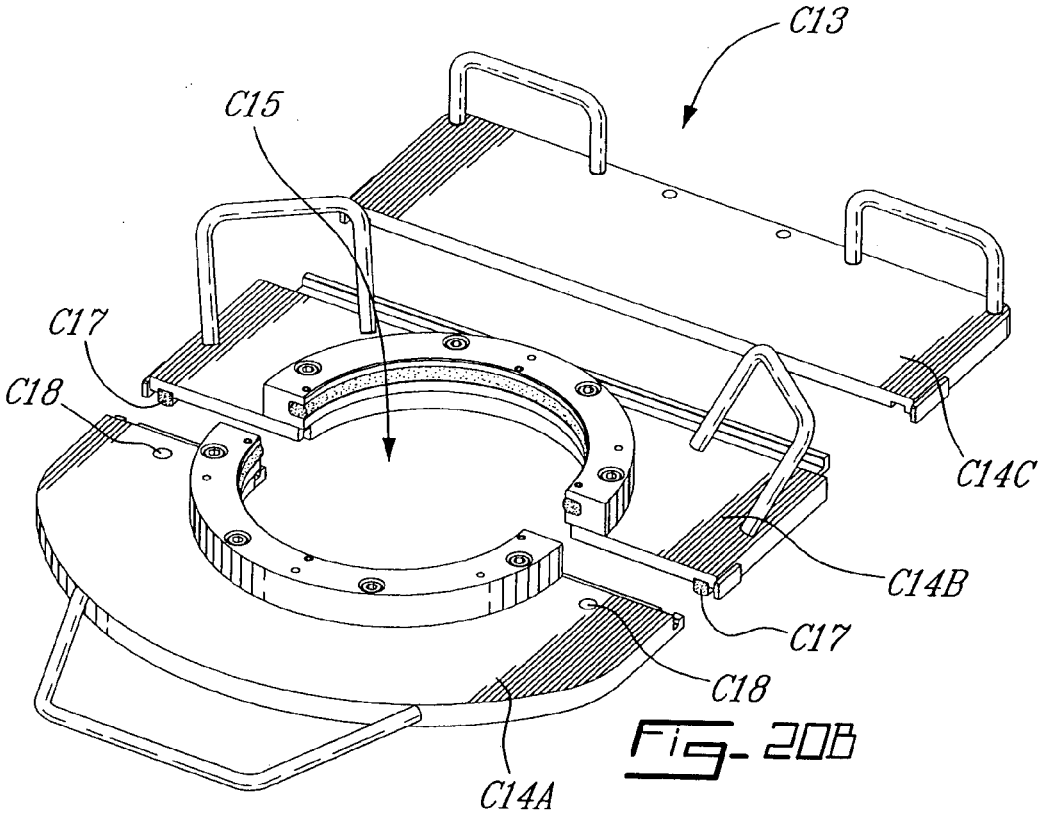
FIG. 20B is an exploded view of the panel of FIG. 20A.

In a preferred embodiment of the present invention, the injection access portion C13 consists of three panels, which are shown at C14A, C14B and C14C in FIGS. 20A and 20B. The panels C14A and C14B define an opening C15, which sealingly receives the base portion J20 of the injection unit J, such that a bottom portion of the base portion J20 is in the bath of molten casting medium of the crucible C20. The panel C14C is adjacent to the panel C14B. The panels C14 are interconnected by keyed connection at junctions thereof, with mating keyed connector portions shown in FIG. 20B, whereby the panels C14 can be opened individually to access the inside of the crucible C20, while being hermetically connected to one another. More particularly, the panel C14C can be removed in the presence of the injection J, for accessing the inside of the crucible C20, e.g., for maintenance and cleaning. Various gaskets/seals C17 ensure the air tightness of the injection access portion C13. For instance, one of the seals C17 is provided at a periphery of the opening C15, whereby the base portion J20 is received in a generally airtight fashion.

Figure 18B:
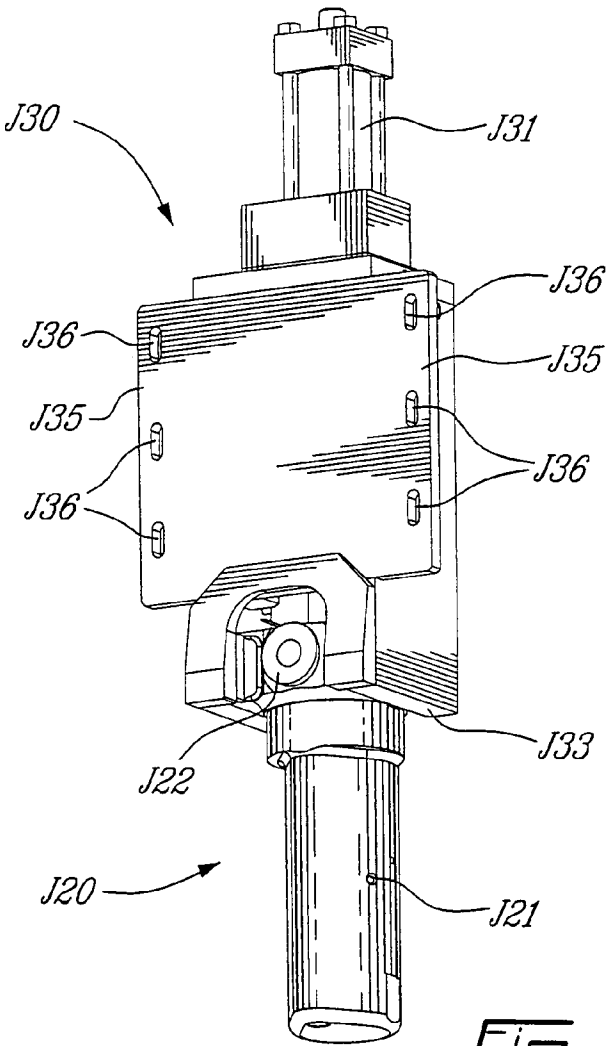
FIG. 18B is a front right-side perspective view of the base portion of the gooseneck and the actuation portion of the injection unit.
Figure 18A:
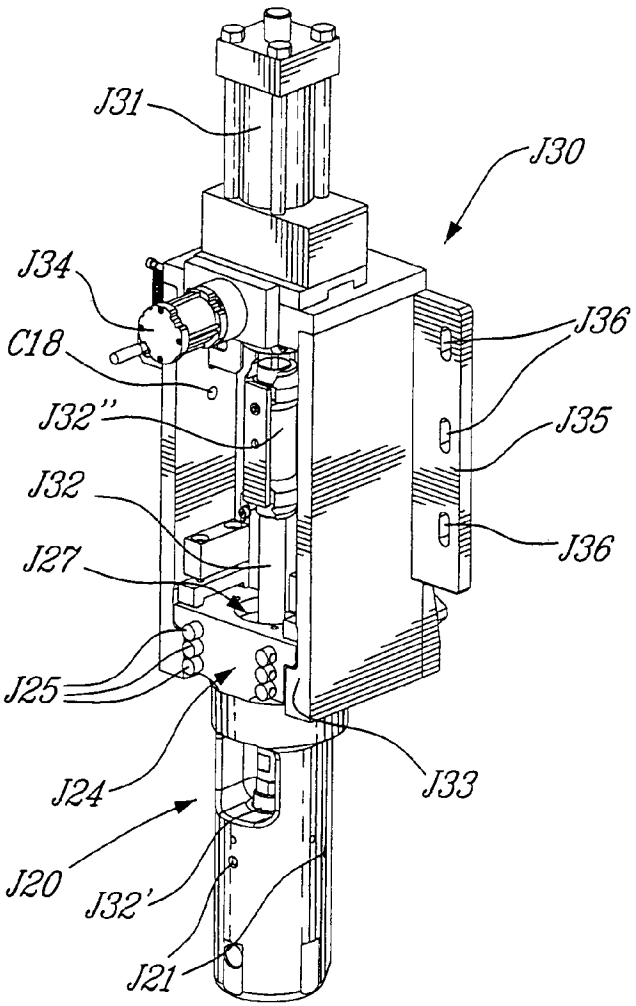
FIG. 18A is a rear left-side perspective view of a base portion of the gooseneck connected to an actuation portion of the injection unit.

Ports C18 are provided on the panels C14 such that the shielding fluid (e.g., $SF_6$) can be injected to form the shielding layer on the surface of the molten casting medium. The layer of $SF_6$ will reduce the oxidation of the casting medium, as it will form a barrier between the casting medium and ambient air. As shown in FIG. 18A, one such port C18 is provided on the casing of the actuation portion J30 of the injection unit J, as the molten casting medium of the crucible C20 is exposed thereat to ambient air.

The access door portion C12 has a panel that is pivotally mounted to a frame portion, so as to be pivoted between opened and closed positions. The opened position of the access door portion C12 is illustrated in FIG. 16A, whereas the closed position of the access door portion C12 is illustrated in FIG. 16B. Ingots of solid medium are fed through the access door portion C12 by way of an automated system (not shown), or manually. Suitable sealing (e.g., gaskets) is provided to hermetically seal the periphery of the access door portion C12 in the closed position, to substantially prevent air infiltration in the furnace C10.

The crucible C20 has a concave bottom, such that material precipitated from the casting medium can accumulate at a bottom of the crucible C20, and be readily scooped out of the crucible C20. The outside C21 of the crucible C20 is preferably a stainless steel layer roll bonded on mild steel, to prevent oxidation of the outside of the crucible C20 in case of an overflow of casting medium from the crucible C20. Moreover, a strip of stainless steel or equivalent (e.g., ceramic) is overlaid on a top portion of the inside C22 of the crucible C20, to inhibit corrosion of the inside C22 of the crucible C20 in the event that the layer of shielding fluid is incorrectly adjusted (e.g., too high concentration of $SF_6$) or that the moisture content of air is excessively high. The crucible C20 may also all be constructed of stainless steel, or may have a stainless steel internal cladding preferably of low nickel content to avoid contamination of the molten magnesium, and a stainless steel external cladding suited for sustaining high temperatures with minimal corrosion.

A door C30 is provided at a bottom of the furnace C10 so as to provide an outlet for leaking casting medium. The frame may be provided with an absorbent in an overflow reservoir (not shown). The absorbent is typically dry sand in polyethylene bags, with the overflow reservoir being positioned opposite the door C30, to collect the casting medium.

Interconnection Between the Injection Unit J and the Hot Chamber C

Referring to FIG. 16B, the furnace C10 is provided with a removable support bracket C40, to be used for removing the gooseneck J10 from the furnace C10. The base portion J20 is received in the opening C15, with one of the seals C17 (FIG. 20A) ensuring the air tightness therebetween. The removable support bracket C40 can be fastened to the top of the head portion J24 of the gooseneck J10, such that the support bracket C40 can serve as a connector for, e.g., a crane to lift the gooseneck J10 to remove it from the furnace C10.

As mentioned previously, the actuation portion J30 of the injection unit J often remains on the arch F20, while the gooseneck portion J10 (i.e., nozzle adapter J11 and the base portion J20) are removed. In such a case, the support bracket C40 supports the base portion J20, such that the latter is supported when disconnected from the actuation portion J30. Similarly, the gooseneck J10 can be installed individually on the furnace C10, as supported by the support bracket C40, to then be connected to the actuation portion J30 by displacing the hot chamber C toward the arch F20, until the base portion J20 engages with the actuation portion J30.

The support bracket C40 can be disconnected from the furnace C10, to serve as a connector for removing the gooseneck J10 from the furnace C10. As the gooseneck J10 is subjected to high temperature while it is in contact with the molten casting medium, it is preferred to use supporting structures (e.g., a crane), to remove the gooseneck J10. For such purposes, the detached support bracket C40 can be used as a connector between the gooseneck J10 and, for instance, a crane.

Casting Media

The parting-line multiple-slide die-casting machine A of the present invention can be used to mold various metals and metal alloys. This die-casting machine of the present invention is adapted for casting magnesium, with appreciable results. Problems of known die-casting machines have been addressed by the die-casting machine of the present invention.

For efficient die casting of magnesium, the oxidation of the molten magnesium has to be reduced. One major cause of oxidation in known die-casting machines is the constant displacement of the injection unit in the molten magnesium bath. In a preferred embodiment of the present invention, the table T, incorporating the slides, is pivotally mounted to the frame F, so as to be displaceable toward the stationary injection unit J and hot chamber C. Therefore, when the injection unit J is adjusted in position, it remains stationary, and thus does not disrupt the barrier of shielding fluid on the top surface of the molten medium bath.

Another source of oxidation is the improper feed of the shielding gas to the furnace C10 of the hot chamber C. In the present invention, additional ports C18 are provided to ensure the adequate feed of shielding gas to the furnace C10. Also, the air tightness of the interactions (e.g., injection unit J secured to the furnace C10) also helps in reducing the level of oxidation.

Moreover, the crucible C20 has been coated with layers of stainless steel to be protected from the higher temperature of molten magnesium when compared to other casting media (e.g., zinc). Also, the addition of several heating cartridges in the piston portion J20 and the nozzle adapter J11 will prevent the magnesium from solidifying in the injection unit J.

It is preferred to use electrical power for safety purposes and accurate control when die casting magnesium. A mixture of molten magnesium and hydraulic oil (e.g., in the event that a hydraulic heating line leaks) can be highly reactive, whereby electrical power is preferred when possible for the die-casting machine A. For instance, the hot chamber C is preferably electrically powered, as are the heating cartridges of the piston portion J20.

It is within the ambit of the present invention to cover any obvious modifications of the preferred embodiment described herein, provided such modifications fall within the scope of the appended claims.

We claim:

1. An injection unit for a hot-chamber die-casting machine, comprising:

an injection portion having a gooseneck and a nozzle adapter, the injection portion having a base portion at an end of the gooseneck adapted to receive a molten medium supply, a nozzle at an end of the nozzle adapter adapted to inject the molten medium supply in a die cavity, a channel between the base portion and the nozzle adapted for conveying the molten medium supply therethrough, and a piston chamber in the base portion actuatable to draw the molten medium supply therein and to direct the molten medium supply in the channel for injection into said die cavity;

an actuation portion connected to the gooseneck to actuate the piston chamber;

slots in the injection portion along the channel;

sleeves each received in one of the slots in the injection portion adjacent to the channel; and heating cartridges each accommodated in one of the sleeves to control a temperature of the molten medium supply in the channel, such that any one of the heating cartridges is removed from the injection portion by removing the sleeve accommodating the heating cartridge.

2. The injection unit according to claim 1, wherein the base portion is immersed in a bath of the molten medium.

3. The injection unit according to claim 1, wherein the heating cartridges are generally parallel and radially spaced from the channel.

4. The injection unit according to claim 1, further comprising thermocouples disposed along the channel to control the temperature of the molten medium supply.

5. The injection unit according to claim 1, wherein the at least one sleeve is a flanged-head sleeve.

6. The injection unit according to claim 1, further comprising locking means selectively cooperating with the actuation portion to lock the injection unit.

7. The injection unit according to claim 1, wherein the actuation portion is separable from the gooseneck, such that the actuation portion can remain secured to the die-casting machine while the gooseneck is removed.

8. The injection unit according to claim 1, wherein the medium is magnesium.

9. The injection unit according to claim 1, wherein the piston chamber is defined by an inner cavity of a sleeve, the sleeve being removable from the base portion so as to be replaceable when worn.

10. An injection unit for a hot-chamber die-casting machine, comprising:

an injection portion having a gooseneck and a nozzle adapter, the injection portion having a base portion at an end of the gooseneck adapted to receive a molten medium supply, a nozzle at an end of the nozzle adapter adapted to inject the molten medium supply in a die cavity, a channel between the base portion and the nozzle adapted for conveying the molten medium supply therethrough, and a piston chamber in the base portion defined by an inner cavity of a removable sleeve, the piston chamber being actuatable to draw the molten medium supply therein and to direct the molten medium supply in the channel for injection into said die cavity, the removable sleeve being removed from the base portion so as to be replaced when worn; and an actuation portion connected to the gooseneck to actuate the piston chamber.

11. The injection unit according to claim 10, wherein the base portion is immersed in a bath of the molten medium.

12. The injection unit according to claim 10, further comprising locking means selectively cooperating with the actuation portion to lock the injection unit.

13. The injection unit according to claim 10, wherein the actuation portion is separable from the gooseneck, such that the actuation portion can remain secured to the die-casting machine while the gooseneck is removed.

14. The injection unit according to claim 10, wherein the medium is magnesium.

* * * * *